US012601526B2

(12) United States Patent
Yamanoi et al.

(10) Patent No.: US 12,601,526 B2
(45) Date of Patent: Apr. 14, 2026

(54) REFRIGERATION CYCLE SYSTEM

(71) Applicant: DAIKIN INDUSTRIES, LTD., Osaka (JP)

(72) Inventors: Yoshiki Yamanoi, Osaka (JP); Yuuta Iyoshi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 504 days.

(21) Appl. No.: 17/981,268

(22) Filed: Nov. 4, 2022

(65) Prior Publication Data

US 2023/0056663 A1 Feb. 23, 2023

Related U.S. Application Data

(63) Continuation of application No. PCT/JP2021/017755, filed on May 10, 2021.

(30) Foreign Application Priority Data

May 8, 2020 (JP) ..... 2020-082789

(51) Int. Cl.
*F25B 9/10* (2006.01)
*F25B 9/00* (2006.01)
*F25B 49/02* (2006.01)

(52) U.S. Cl.
CPC ..... *F25B 9/10* (2013.01); *F25B 9/008* (2013.01); *F25B 49/022* (2013.01); *F25B 2500/26* (2013.01); *F25B 2600/2501* (2013.01)

(58) Field of Classification Search
CPC .... F25B 49/022; F25B 2500/26; F25B 9/008; F25B 9/10
See application file for complete search history.

(56) References Cited

U.S. PATENT DOCUMENTS

2021/0333021 A1* 10/2021 Matsuoka ..... F25B 29/003

FOREIGN PATENT DOCUMENTS

EP 3 348 934 A1 7/2018
JP 59-38568 A 3/1984
(Continued)

OTHER PUBLICATIONS

International Search Report for PCT/JP2021/017755 (PCT/ISA/210) mailed on Jul. 6, 2021.
(Continued)

*Primary Examiner* — Nael N Babaa
(74) *Attorney, Agent, or Firm* — Birch, Stewart, Kolasch & Birch, LLP

(57) ABSTRACT

A refrigeration cycle system includes a first cycle and a second cycle. The first cycle is connected with a first compressor, a cascade heat exchanger, a first expansion unit, and a first heat exchanger, and includes a first flow path that connects the first compressor to the cascade heat exchanger, a second flow path that connects the cascade heat exchanger to the first expansion unit, a third flow path that connects the first heat exchanger to the first compressor, and a bypass flow path that connects at least one of the first flow path and the second flow path to the third flow path. The second cycle includes the cascade heat exchanger. In a case of using the cascade heat exchanger as a radiator of the first cycle and a heat sink of the second cycle, the first compressor of the first cycle is started after a flow of a heat medium generates in the cascade heat exchanger in the second cycle.

20 Claims, 11 Drawing Sheets

(56) References Cited

FOREIGN PATENT DOCUMENTS

| | | | |
|---|---|---|---|
| JP | 2000-121183 | A | 4/2000 |
| JP | 2003-28524 | A | 1/2003 |
| JP | 2004-190917 | A | 7/2004 |
| JP | 2005-77042 | A | 3/2005 |
| JP | 2007-218460 | A | 8/2007 |
| JP | 2007-248001 | A | 9/2007 |
| JP | 2008-39332 | A | 2/2008 |
| JP | 2012-112615 | A | 6/2012 |
| JP | 2012-184873 | A | 9/2012 |
| JP | 2013-210150 | A | 10/2013 |
| JP | 5488678 | B1 | 5/2014 |
| JP | 2016-11783 | A | 1/2016 |
| JP | 2019-20090 | A | 2/2019 |
| WO | WO 2018/235832 | A1 | 12/2018 |

OTHER PUBLICATIONS

Written Opinion of the International Searching Authority for PCT/JP2021/017755 (PCT/ISA/237) mailed on Jul. 6, 2021.

Extended European Search Report for European Application No. 21800672.4, dated Sep. 5, 2023.

International Preliminary Report on Patentability and English translation of the Written Opinion of the International Searching Authority for International Application No. PCT/JP2021/017705, dated Nov. 17, 2022.

International Preliminary Report on Patentability and English translation of the Written Opinion of the International Searching Authority for International Application No. PCT/JP2021/017755, dated Nov. 17, 2022.

Extended European Search Report for European Application No. 21800967.8, dated Oct. 5, 2023.

* cited by examiner

REFRIGERATION CYCLE SYSTEM

CROSS REFERENCE TO RELATED APPLICATIONS

This application is a Continuation of PCT International Application No. PCT/JP2021/017755, filed on May 10, 2021, which claims priority under 35 U.S.C. 119(a) to Patent Application No. 2020-082789, filed in Japan on May 8, 2020, all of which are hereby expressly incorporated by reference into the present application.

TECHNICAL FIELD

The present disclosure relates to a refrigeration cycle system.

BACKGROUND ART

Conventionally, there is known a dual refrigeration apparatus in which a primary-side refrigerant circuit and a secondary-side refrigerant circuit are connected via a cascade heat exchanger. In the case of using a carbon dioxide refrigerant in the secondary-side refrigerant circuit of such a dual refrigeration apparatus, the pressure of the discharged refrigerant transiently increases at the start of the secondary-side refrigerant circuit, and thus there is a problem that the design pressure in the secondary-side refrigerant circuit increases.

Regarding this matter, for example, a refrigeration apparatus described in Patent Literature 1 (JP 2004-190917 A) proposes that a compressor constituting a primary-side refrigerant circuit is started before a compressor constituting a secondary-side refrigerant circuit is started in order to suppress the transient increase in the discharge refrigerant pressure at the start of the secondary-side refrigerant circuit.

SUMMARY

A refrigeration cycle system according to a first aspect includes a first cycle and a second cycle. The first cycle includes a first compressor, a cascade heat exchanger, a first expansion unit, and a first heat exchanger, which are connected to each other. In the first cycle, a carbon dioxide refrigerant circulates. The first cycle includes a first flow path, a second flow path, a third flow path, and a bypass flow path. The first flow path connects the first compressor to the cascade heat exchanger. The second flow path connects the cascade heat exchanger to the first expansion unit. The third flow path connects the first heat exchanger to the first compressor. The bypass flow path connects at least one of the first flow path and the second flow path to the third flow path. The second cycle includes the cascade heat exchanger. In the second cycle, a heat medium different from the carbon dioxide refrigerant circulates. In the refrigeration cycle system, in the case of using the cascade heat exchanger as a radiator of the first cycle and a heat sink of the second cycle, the first compressor of the first cycle is started after a flow of the heat medium generates in the cascade heat exchanger in the second cycle.

DESCRIPTION OF EMBODIMENTS

(1) Configuration of Refrigeration Cycle System

Figure 1:
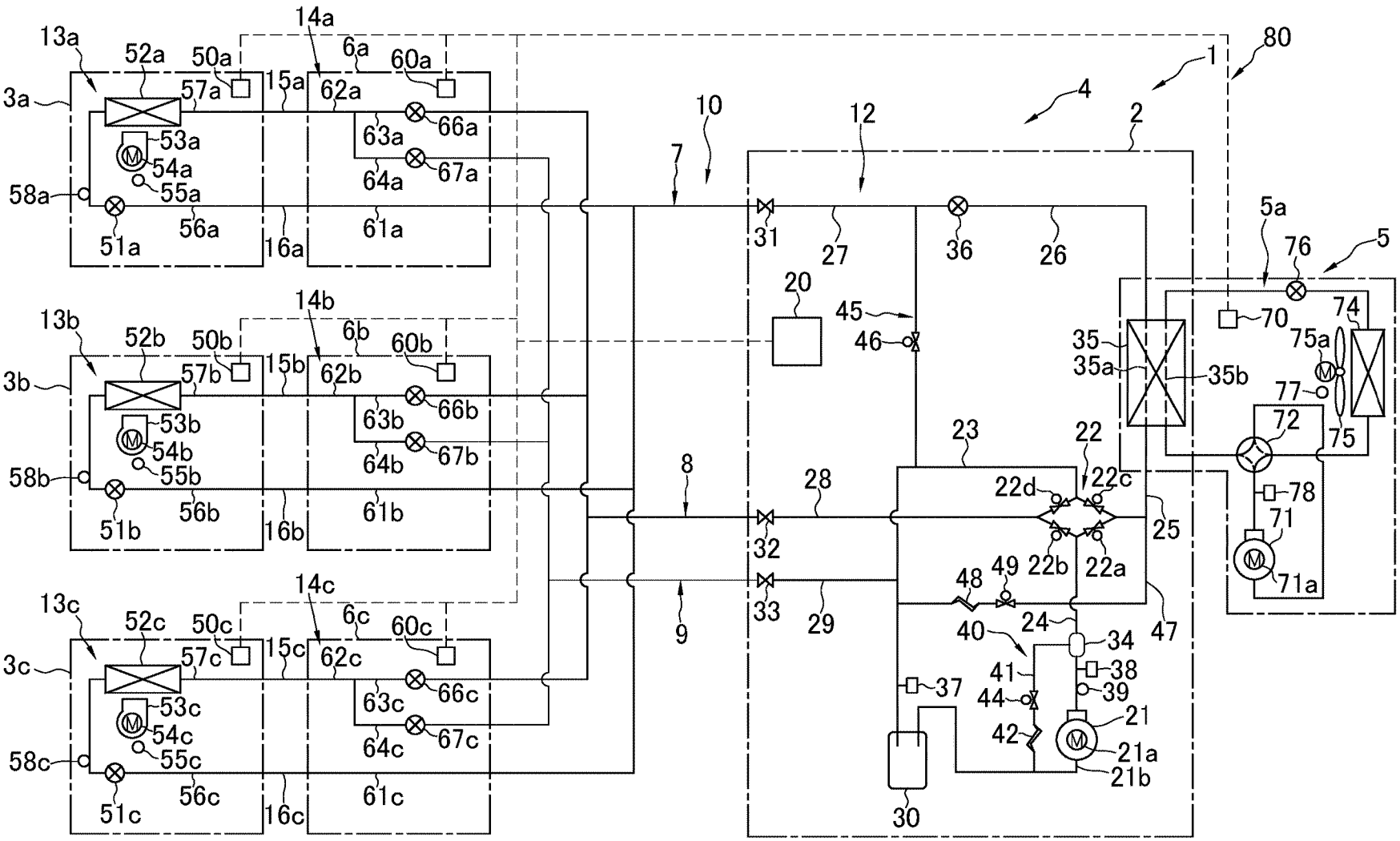
FIG. 1 is a schematic configuration diagram of a refrigeration cycle system.
Figure 2:
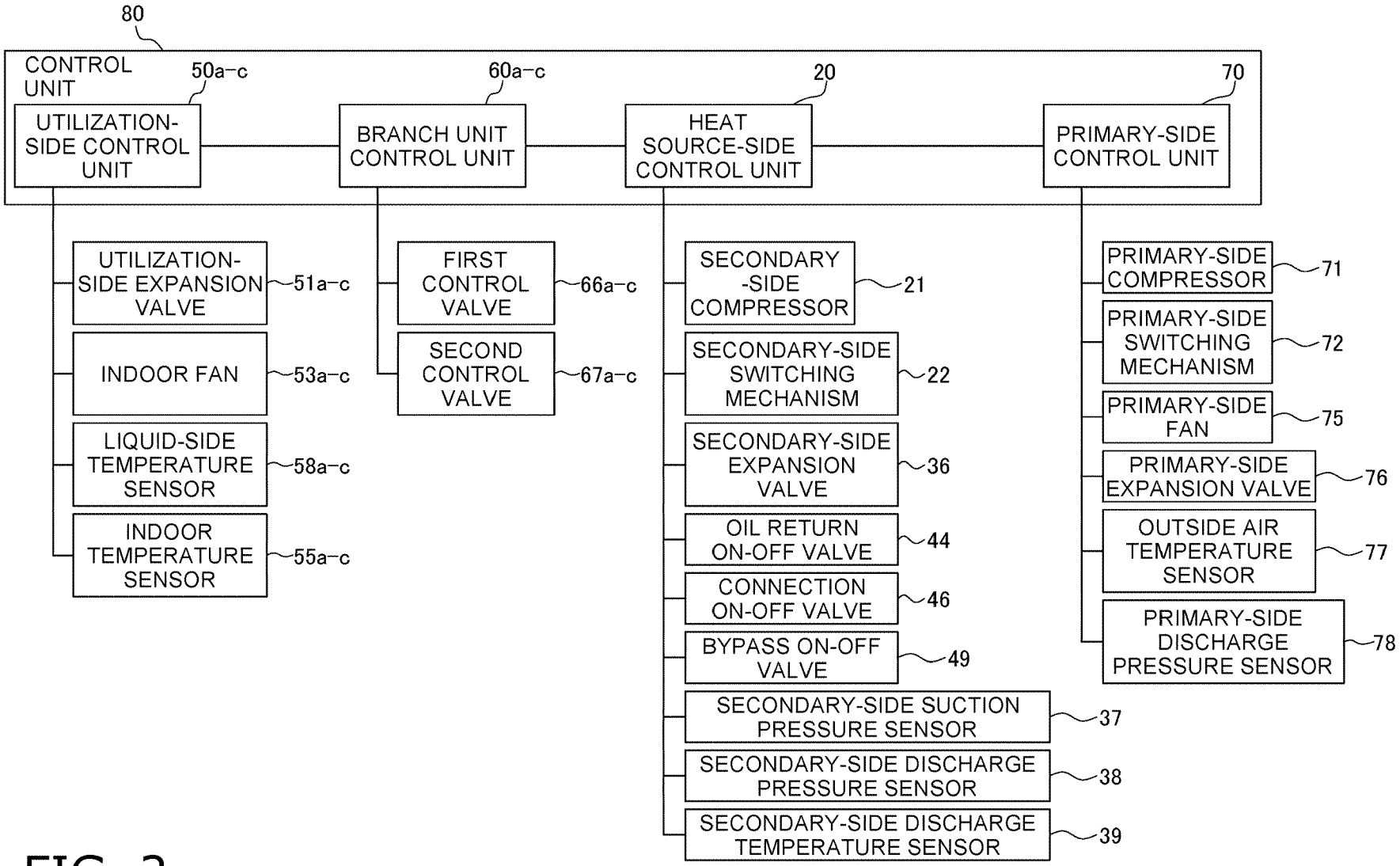
FIG. 2 is a schematic functional block configuration diagram of the refrigeration cycle system 1.

FIG. 1 is a schematic configuration diagram of a refrigeration cycle system 1. FIG. 2 is a schematic functional block configuration diagram of the refrigeration cycle system 1.

The refrigeration cycle system 1 is an apparatus used for cooling and heating of a room of such as a building by performing a vapor compression refrigeration cycle operation.

The refrigeration cycle system 1 includes a primary-side unit 5 and a secondary-side unit 4 (corresponding to a refrigeration cycle apparatus), and includes a dual refrigerant circuit that performs a dual refrigeration cycle.

The primary-side unit 5 includes a vapor compression primary-side refrigerant circuit 5*a* (corresponding to a second cycle). In the primary-side refrigerant circuit 5*a*, R32 (corresponding to a heat medium) or the like is sealed as a refrigerant.

The secondary-side unit 4 includes a vapor compression secondary-side refrigerant circuit 10 (corresponding to a first cycle). In the secondary-side refrigerant circuit 10, carbon dioxide is sealed as a refrigerant. The primary-side unit 5 and the secondary-side unit 4 are connected via a cascade heat exchanger 35 to be described later.

The secondary-side unit 4 has a configuration in which a plurality of branch units 6*a*, 6*b*, and 6*c* corresponding to the utilization units 3*a*, 3*b*, and 3*c*, respectively, are respectively connected via first connecting pipes 15*a*, 15*b*, and 15*c* and second connecting pipes 16*a*, 16*b*, and 16*c*, and the plurality of branch units 6*a*, 6*b*, and 6*c* is connected to a heat source unit 2 via three connection pipes 7, 8, and 9. In the present embodiment, the number of the plurality of utilization units 3*a*, 3*b*, and 3*c* provided is three, which are the first utilization unit 3*a*, the second utilization unit 3*b*, and the third utilization unit 3*c*. In the present embodiment, the number of the plurality of branch units 6*a*, 6*b*, and 6*c* provided is three, which are the first branch unit 6*a*, the second branch unit 6*b*, and the third branch unit 6*c*. In the present embodiment, the number of the heat source unit 2 provided is one. The three connection pipes are respectively referred to as the first connection pipe 8, the second connection pipe 9, and the third connection pipe 7. Any one of the refrigerant in the supercritical state, the refrigerant in the gas-liquid two-phase state, and the refrigerant in the gas state flows through the first connection pipe 8 according to the operation state. Any one of the refrigerant in the gas-liquid two-phase state and the refrigerant in the gas state flows through the second connection pipe 9 according to the operation state. Any one of the refrigerant in the supercritical state, the refrigerant in the gas-liquid two-phase state, and the refrigerant in the liquid state flows through the third connection pipe 7 according to the operation state.

In addition, in the refrigeration cycle system 1, the utilization units 3*a*, 3*b*, and 3*c* can individually perform cooling operation or heating operation, and heat recovery can be performed between the utilization units by sending the refrigerant from the utilization unit performing the heating operation to the utilization unit performing the cooling operation. Specifically, in the present embodiment, the heat recovery is performed by performing the cooling dominant operation and the heating dominant operation in which the cooling operation and the heating operation are simultaneously performed. The refrigeration cycle system 1 is configured to balance the heat load of the heat source unit 2 in accordance with the heat load of the whole of the plurality of utilization units 3*a*, 3*b*, and 3*c* in consideration of the above-described heat recovery (the cooling dominant operation and the heating dominant operation).

(2) Primary-Side Unit

The primary-side unit 5 includes a primary-side refrigerant circuit 5*a*, a primary-side fan 75, and a primary-side control unit 70.

The primary-side refrigerant circuit 5*a* includes a primary-side compressor 71 (corresponding to a second compressor), a primary-side switching mechanism 72, a primary-side heat exchanger 74, a primary-side expansion valve 76, and a cascade heat exchanger 35 shared with the secondary-side refrigerant circuit 10. The primary-side refrigerant circuit 5*a* constitutes a primary-side refrigerant circuit in the refrigeration cycle system 1, and has a refrigerant such as R32 circulated therein.

The primary-side compressor 71 is a device for compressing a primary-side refrigerant, and includes, for example, a scroll type or other positive displacement compressor whose operating capacity can be varied by inverter-controlling a compressor motor 71*a*.

In the case where the cascade heat exchanger 35 is made to function as an evaporator for the primary-side refrigerant, the primary-side switching mechanism 72 is brought into a fifth connection state where the suction side of the primary-side compressor 71 is connected to the gas side of a primary-side flow path 35*b* of the cascade heat exchanger 35 (see a solid line of the primary-side switching mechanism 72 in FIG. 1). Further, in the case where the cascade heat exchanger 35 is made to function as a radiator for the primary-side refrigerant, the primary-side switching mechanism 72 is brought into a sixth connection state where the discharge side of the primary-side compressor 71 is connected to the gas side of the primary-side flow path 35*b* of the cascade heat exchanger 35 (see a broken line of the primary-side switching mechanism 72 in FIG. 1). As described above, the primary-side switching mechanism 72 is a device that can switch the flow path of refrigerant in the primary-side refrigerant circuit 5*a*, and includes, for example, a four-way switching valve. Then, by changing the switching state of the primary-side switching mechanism 72, the cascade heat exchanger 35 can function as the evaporator or the radiator for the primary-side refrigerant.

The cascade heat exchanger 35 is a device for performing heat exchange between the refrigerant such as R32, which is the primary-side refrigerant, and carbon dioxide, which is the secondary-side refrigerant, without mixing the refrigerants with each other. The cascade heat exchanger 35 is, for example, a plate-type heat exchanger. The cascade heat exchanger 35 includes a secondary-side flow path 35*a* belonging to the secondary-side refrigerant circuit 10 and the primary-side flow path 35*b* belonging to the primary-side refrigerant circuit 5*a*. The secondary-side flow path 35*a* has the gas side connected to a secondary-side switching mechanism 22 via a third heat source pipe 25 (corresponding to a first flow path), and a liquid side connected to a secondary-side expansion valve 36 via a fourth heat source pipe 26 (corresponding to a second flow path). The primary-side flow path 35*b* has the gas side connected to the primary-side compressor 71 via the primary-side switching mechanism 72 and the liquid side connected to the primary-side expansion valve 76.

The primary-side expansion valve 76 is provided in a liquid pipe between the cascade heat exchanger 35 and the primary-side heat exchanger 74 of the primary-side refrigerant circuit 5*a*. The primary-side expansion valve 76 is an electrically powered expansion valve whose opening degree can be controlled and that performs control and the like of the flow rate of the primary-side refrigerant flowing through the liquid side portion of the primary-side refrigerant circuit 5*a*.

The primary-side heat exchanger 74 is a device for exchanging heat between the primary-side refrigerant and the indoor air, and includes, for example, a fin-and-tube heat exchanger including a large number of heat transfer tubes and fins.

The primary-side fan 75 is provided in the primary-side unit 5, and generates an air flow that guides the outdoor air to the primary-side heat exchanger 74, exchanges heat with the primary-side refrigerant flowing through the primary-side heat exchanger 74, and then discharges the air to the outdoors. The primary-side fan 75 is driven by a primary-side fan motor 75*a*.

Further, the primary-side unit 5 is provided with various sensors. Specifically, the primary-side unit 5 is provided with an outside air temperature sensor 77 that detects the temperature of the outdoor air before the air passes through the primary-side heat exchanger 74, and a primary-side discharge pressure sensor 78 that detects the pressure of the primary-side refrigerant discharged from the primary-side compressor 71.

The primary-side control unit 70 controls operation of respective units 71 (71*a*), 72, 75 (75*a*), and 76 that constitute the primary-side unit 5. Further, the primary-side control unit 70 includes a processor such as a CPU and a microcomputer, and a memory, which are provided for controlling the primary-side unit 5, and is configured to be able to exchange control signals and the like with a remote controller (not shown), and exchange control signals and the like with a heat source-side control unit 20, branch unit control units 60*a*, 60*b*, and 60*c*, and utilization-side control units 50*a*, 50*b*, and 50*c* of the secondary-side unit 4.

(3) Secondary-Side Unit

The secondary-side unit 4 is configured by connecting the plurality of utilization units 3*a*, 3*b*, and 3*c*, the plurality of branch units 6*a*, 6*b*, and 6*c*, and the heat source unit 2 to each other. The utilization units 3*a*, 3*b*, and 3*c* are connected one-to-one with the corresponding branch units 6*a*, 6*b*, and 6*c*. Specifically, the utilization unit 3*a* and the branch unit 6*a* are connected via the first connecting pipe 15*a* and the second connecting pipe 16*a*, the utilization unit 3*b* and the branch unit 6*b* are connected via the first connecting pipe 15*b* and the second connecting pipe 16*b*, and the utilization unit 3*c* and the branch unit 6*c* are connected via the first connecting pipe 15*c* and the second connecting pipe 16*c*. Further, each of the branch units 6*a*, 6*b*, and 6*c* is connected to the heat source unit 2 via three connection pipes, that is, the third connection pipe 7, the first connection pipe 8, and the second connection pipe 9. Specifically, each of the third connection pipe 7, the first connection pipe 8, and the second connection pipe 9 extending from the heat source unit 2 is branched into a plurality of pipes and connected to the respective branch units 6*a*, 6*b*, and 6*c*.

(3-1) Utilization Unit

The utilization units 3*a*, 3*b*, and 3*c* are installed, such as by being embedded in or suspended from a ceiling in a room such as a building, or by being hung on a wall surface in the room. The utilization units 3*a*, 3*b*, and 3*c* are connected to the heat source unit 2 via the connection pipes 7, 8, and 9, and respectively include utilization circuits 13*a*, 13*b*, and 13*c* constituting a part of the secondary-side refrigerant circuit 10.

Next, configurations of the utilization units 3*a*, 3*b*, and 3*c* are described. Note that, because the second utilization unit 3*b* and the third utilization unit 3*c* have the similar configuration with the first utilization unit 3*a*, only the configuration of the first utilization unit 3*a* is described herein. For the configurations of the second utilization unit 3*b* and the third utilization unit 3*c*, instead of a suffix "a" indicating each part of the first utilization unit 3*a*, a suffix "b" or "c" is added, respectively, and the description of each part is omitted.

The first utilization unit 3*a* mainly includes a utilization circuit 13*a*, an indoor fan 53*a*, and a utilization-side control unit 50*a*, which constitute a part of the secondary-side refrigerant circuit 10. The indoor fan 53*a* includes an indoor fan motor 54*a*. The second utilization unit 3*b* includes a utilization circuit 13*b*, an indoor fan 53*b*, a utilization-side control unit 50*b*, and an indoor fan motor 54*b*. The third utilization unit 3*c* includes a utilization circuit 13*c*, an indoor fan 53*c*, a utilization-side control unit 50*c*, and an indoor fan motor 54*c*.

The utilization circuit 13*a* mainly includes a utilization-side heat exchanger 52*a* (corresponding to a first heat exchanger), a first utilization pipe 57*a*, a second utilization pipe 56*a*, and a utilization-side expansion valve 51*a*.

The utilization-side heat exchanger 52*a* is a device for exchanging heat between the refrigerant and the indoor air, and includes, for example, a fin-and-tube heat exchanger including a large number of heat transfer tubes and fins. Further, the utilization unit 3*a* includes the indoor fan 53*a* that sucks the indoor air into the utilization unit, exchanges heat with the refrigerant flowing in the utilization-side heat exchanger 52*a*, and then supplies the indoor air into the room as supply air. The indoor fan 53*a* is driven by the indoor fan motor 54*a*. The plurality of utilization-side heat exchangers 52*a*, 52*b*, and 52*c* are connected in parallel to the secondary-side switching mechanism 22, the suction flow path 23, and the cascade heat exchanger 35.

One end of the second utilization pipe 56*a* is connected to the liquid side (the side opposite to the gas side) of the utilization-side heat exchanger 52*a* of the first utilization unit 3*a*. The other end of the second utilization pipe 56*a* is connected to the second connecting pipe 16*a*. The utilization-side expansion valve 51*a* described above is provided in the middle of the second utilization pipe 56*a*.

The utilization-side expansion valve 51*a* is an electrically powered expansion valve whose opening degree can be controlled and that performs control and the like of the flow rate of the refrigerant flowing through the utilization-side heat exchanger 52*a*. The utilization-side expansion valve 51*a* is provided in the second utilization pipe 56*a*.

One end of the first utilization pipe 57*a* is connected to the gas side of the utilization-side heat exchanger 52*a* of the first utilization unit 3*a*. In the present embodiment, the first utilization pipe 57*a* is connected to the utilization-side heat exchanger 52*a* on the side opposite to the utilization-side expansion valve 51*a*. The other end of the first utilization pipe 57*a* is connected to the first connecting pipe 15*a*.

Further, the utilization unit 3*a* is provided with various sensors. Specifically, a liquid-side temperature sensor 58*a* is provided, the sensor detecting the temperature of the refrigerant on the liquid side of the utilization-side heat exchanger 52*a*. In addition, the utilization unit 3*a* is provided with an indoor temperature sensor 55*a* that detects the indoor temperature that is the temperature of the air taken in from the room and before passing through the utilization-side heat exchanger 52*a*.

The utilization-side control unit 50*a* controls operation of respective units 51*a* and 53*a* (54*a*) that constitute the utilization unit 3*a*. Further, the utilization-side control unit 50*a* includes a processor such as a CPU and a microcomputer, and a memory, which are provided for controlling the utilization unit 3*a*, and is configured to be able to exchange control signals and the like with a remote controller (not shown), and exchange control signals and the like with the heat source-side control unit 20 and the branch unit control units 60*a*, 60*b*, and 60*c* of the secondary-side unit 4, and with the primary-side control unit 70 of the primary-side unit 5.

(3-2) Branch Unit

The branch units 6*a*, 6*b*, and 6*c* are connected to the utilization units 3*a*, 3*b*, and 3*c* in a one-to-one correspondence, and are installed in a space or the like above a ceiling of a room such as a building. The branch units 6*a*, 6*b*, and 6*c* are each connected to the heat source unit 2 via the connection pipes 7, 8, and 9. The branch units 6*a*, 6*b*, and 6*c* respectively include branch circuits 14*a*, 14*b*, and 14*c* constituting a part of the secondary-side refrigerant circuit 10.

Next, configurations of the branch units 6*a*, 6*b*, and 6*c* are described. Note that, because the second branch unit 6*b* and the third branch unit 6*c* have the similar configuration with the first branch unit 6*a*, only the configuration of the first branch unit 6*a* is described herein. For the configurations of the second branch unit 6*b* and the third branch unit 6*c*, instead of a suffix "a" indicating each part of the first branch unit 6*a*, a suffix "b" or "c" is added, respectively, and the description of each part is omitted.

The first branch unit 6*a* mainly includes the branch circuit 14*a* constituting a part of the secondary-side refrigerant circuit 10, and the branch unit control unit 60*a*. In addition, the second branch unit 6*b* includes the branch circuit 14*b* and the branch unit control unit 60*b*. The third branch unit 6*c* includes the branch circuit 14*c* and the branch unit control unit 60*c*.

The branch circuit 14*a* mainly includes a junction pipe 62*a*, a first branch pipe 63*a*, a second branch pipe 64*a*, a first control valve 66*a*, a second control valve 67*a*, and a third branch pipe 61*a*.

One end of the junction pipe 62*a* is connected to the first connecting pipe 15*a*. The other end of the junction pipe 62*a* is connected to the first branch pipe 63*a* and the second branch pipe 64*a* that are branched from the junction pipe.

The first branch pipe 63*a* is connected to the first connection pipe 8 on the side opposite to the side of the junction pipe 62. The first branch pipe 63*a* is provided with the first control valve 66*a* that can be opened and closed. Note that an electrically powered expansion valve whose opening degree can be controlled is adopted herein as the first control valve 66*a*, but an electromagnetic valve that can only be opened and closed may be adopted.

The second branch pipe 64*a* is connected to the second connection pipe 9 on the side opposite to the side of the junction pipe 62. The second branch pipe 64*a* is provided with the second control valve 67*a* that can be opened and closed. Note that an electrically powered expansion valve whose opening degree can be controlled is adopted herein as the second control valve 67*a*, but an electromagnetic valve that can only be opened and closed may be adopted.

One end of the third branch pipe 61*a* is connected to the second connecting pipe 16*a*. The other end of the third branch pipe 61*a* is connected to the third connection pipe 7.

Further, the first branch unit 6*a* can function as follows by opening the first control valve 66*a* and the second control valve 67*a* when the cooling operation to be described later is performed. The first branch unit 6*a* sends the refrigerant flowing into the third branch pipe 61*a* through the third connection pipe 7 to the second connecting pipe 16*a*. Note that the refrigerant flowing through the second utilization pipe 56*a* of the first utilization unit 3*a* through the second connecting pipe 16*a* is sent to the utilization-side heat exchanger 52*a* of the first utilization unit 3*a* through the utilization-side expansion valve Ma. Then, the refrigerant sent to the utilization-side heat exchanger 52*a* evaporates by heat exchange with the indoor air, and then flows through the first connecting pipe 15*a* via the first utilization pipe 57*a*. The refrigerant having flowed through the first connecting pipe 15*a* is sent to the junction pipe 62*a* of the first branch unit 6*a*. The refrigerant having flowed through the junction pipe 62*a* branches and flows into the first branch pipe 63*a* and the second branch pipe 64*a*. The refrigerant having passed through the first control valve 66*a* in the first branch pipe 63*a* is sent to the first connection pipe 8. The refrigerant having passed through the second control valve 67*a* in the second branch pipe 64*a* is sent to the second connection pipe 9.

In addition, the first branch unit 6*a* can function as follows by bringing the first control valve 66*a* into the closed state and the second control valve 67*a* into the open state in the case of cooling the room by the first utilization unit 3*a* at the time of performing the cooling dominant operation and the heating dominant operation to be described later. The first branch unit 6*a* sends the refrigerant flowing into the third branch pipe 61*a* through the third connection pipe 7 to the second connecting pipe 16*a*. Note that the refrigerant flowing through the second utilization pipe 56*a* of the first utilization unit 3*a* through the second connecting pipe 16*a* is sent to the utilization-side heat exchanger 52*a* of the first utilization unit 3*a* through the utilization-side expansion valve Ma. Then, the refrigerant sent to the utilization-side heat exchanger 52*a* evaporates by heat exchange with the indoor air, and then flows through the first connecting pipe 15*a* via the first utilization pipe 57*a*. The refrigerant having flowed through the first connecting pipe 15*a* is sent to the junction pipe 62*a* of the first branch unit 6*a*. The refrigerant having flowed through the junction pipe 62*a* flows into the second branch pipe 64*a*, passes through the second control valve 67*a*, and is sent to the second connection pipe 9.

Further, the first branch unit 6*a* can function as follows by bringing the second control valve 67*a* into the open state or the close state according to the operation condition as described later and bringing the first control valve 66*a* into the close state at the time of performing the heating operation. In the first branch unit 6*a*, the refrigerant flowing into the first branch pipe 63*a* through the first connection pipe 8 passes through the first control valve 66*a* and is sent to the junction pipe 62*a*. The refrigerant having flowed through the junction pipe 62*a* flows through the first utilization pipe 57*a* of the utilization unit 3*a* via the first connecting pipe 15*a*, and is sent to the utilization-side heat exchanger 52*a*. Then, the refrigerant sent to the utilization-side heat exchanger 52*a* evaporates by heat exchange with the indoor air, and then passes through the utilization-side expansion valve 51*a* provided in the second utilization pipe 56*a*. The refrigerant having passed through the second utilization pipe 56*a* flows through the third branch pipe 61*a* of the first branch unit 6*a* via the second connecting pipe 16*a*, and is sent to the third connection pipe 7.

In addition, the first branch unit 6*a* can function as follows by bringing the second control valve 67*a* into the close state and the first control valve 66*a* into the open state in the case of heating the room by the first utilization unit 3*a* at the time of performing the cooling dominant operation and the heating dominant operation to be described later. In the first branch unit 6*a*, the refrigerant flowing into the first branch pipe 63*a* through the first connection pipe 8 passes through the first control valve 66*a* and is sent to the junction pipe 62*a*. The refrigerant having flowed through the junction pipe 62*a* flows through the first utilization pipe 57*a* of the utilization unit 3*a* via the first connecting pipe 15*a*, and is sent to the utilization-side heat exchanger 52*a*. Then, the refrigerant sent to the utilization-side heat exchanger 52*a* evaporates by heat exchange with the indoor air, and then passes through the utilization-side expansion valve 51*a* provided in the second utilization pipe 56*a*. The refrigerant having passed through the second utilization pipe 56*a* flows through the third branch pipe 61*a* of the first branch unit 6*a* via the second connecting pipe 16*a*, and is sent to the third connection pipe 7.

The above function is provided not only in the first branch unit 6*a* but also in the second branch unit 6*b* and the third branch unit 6*c*. Therefore, each of the first branch unit 6*a*, the second branch unit 6*b*, and the third branch unit 6*c* can individually switch whether each of the utilization-side heat exchangers 52*a*, 52*b*, and 52*c* functions as the evaporator for the refrigerant or the radiator for the refrigerant.

The branch unit control unit 60*a* controls operation of respective units 66*a* and 67*a* that constitute the branch unit 6*a*. Further, the branch unit control unit 60*a* includes a processor such as a CPU and a microcomputer, and a memory, which are provided for controlling the branch unit 6*a*, and is configured to be able to exchange control signals and the like with a remote controller (not shown), and exchange control signals and the like with the heat source-side control unit 20 and the utilization units 3*a*, 3*b*, and 3*c* of the secondary-side unit 4, and with the primary-side control unit 70 of the primary-side unit 5.

(3-3) Heat Source Unit

The heat source unit 2 is installed in a space different from a space in which the utilization units 3*a*, 3*b*, and 3*c* and the branch units 6*a*, 6*b*, and 6*c* are disposed, on a rooftop, or the like. The heat source unit 2 is connected to the branch units 6*a*, 6*b*, 6*c* via the connection pipes 7, 8, and 9, and constitutes a part of the secondary-side refrigerant circuit 10.

Next, a configuration of the heat source unit 2 is described. The heat source unit 2 mainly includes a heat source circuit 12 and the heat source-side control unit 20 that constitute a part of the secondary-side refrigerant circuit 10.

The heat source circuit 12 mainly includes a secondary-side compressor 21 (corresponding to a first compressor), the secondary-side switching mechanism 22 (corresponding to a switching mechanism), a first heat source pipe 28, a second heat source pipe 29, the suction flow path 23 (corresponding to a third flow path), a discharge flow path 24, the third heat source pipe 25 (corresponding to a first flow path), the fourth heat source pipe 26 (corresponding to a second flow path), a fifth heat source pipe 27, the cascade heat exchanger 35, the secondary-side expansion valve 36 (corresponding to a first expansion valve), a third shut-off valve 31, a first shut-off valve 32, a second shut-off valve 33, an accumulator 30, an oil separator 34, an oil return circuit 40, a connection flow path 45, and a bypass flow path 47. Note that the heat source circuit 12 may be the one that does not include, between the cascade heat exchanger 35 and the third shut-off valve 31, a refrigerant container such as a receiver that stores the secondary-side refrigerant.

The secondary-side compressor 21 is a device for compressing the secondary-side refrigerant, and includes, for example, a scroll type or other positive displacement compressor whose operating capacity can be varied by inverter-controlling a compressor motor 21*a*. Note that the secondary-side compressor 21 is controlled to cause the operating capacity to increase as the load increases, according to the load during operation. In addition, the secondary-side compressor 21 may be used, the compressor having a structure in which the refrigerant cannot or substantially cannot move back and forth between the discharge side and the suction side during the stop.

The secondary-side switching mechanism 22 is a mechanism that can switch the connection state of the secondary-side refrigerant circuit 10, particularly, the flow path of the refrigerant in the heat source circuit 12. In the present embodiment, the secondary-side switching mechanism 22 is configured by aligning four switching valves 22*a*, 22*b*, 22*c*, and 22*d*, which are two-way valves, in an annular flow path. Alternatively, a combination of a plurality of three-way switching valves may be used as the secondary-side switching mechanism 22. The secondary-side switching mechanism 22 includes the first switching valve 22*a* provided in a flow path connecting the discharge flow path 24 to the third heat source pipe 25, the second switching valve 22*b* provided in a flow path connecting the discharge flow path 24 to the first heat source pipe 28, the third switching valve 22*c* provided in a flow path connecting the suction flow path 23 to third heat source pipe 25, and the fourth switching valve 22*d* provided in a flow path connecting the suction flow path 23 to the first heat source pipe 28. In the present embodiment, the first switching valve 22*a*, the second switching valve 22*b*, the third switching valve 22*c*, and the fourth switching valve 22*d* are electromagnetic valves that are switched between an open state and a close state.

Further, in the case where the cascade heat exchanger 35 is made to function as a radiator for the secondary-side refrigerant, the secondary-side switching mechanism 22 is brought into a first connection state where the first switching valve 22*a* is brought into the open state and the discharge side of the secondary-side compressor 21 is connected to the gas side of the secondary-side flow path 35*a* of the cascade heat exchanger 35, and meanwhile, the third switching valve 22*c* is brought into the close state. Further, in the case where the cascade heat exchanger 35 is made to function as an evaporator for the secondary-side refrigerant, the secondary-side switching mechanism 22 is brought into a second connection state where the third switching valve 22*c* is brought into the open state and the suction side of the secondary-side compressor 21 is connected to the gas side of the secondary-side flow path 35*a* of the cascade heat exchanger 35, and meanwhile, the first switching valve 22*a* is brought into the close state. Further, in the case where the secondary-side refrigerant discharged from the secondary-side compressor 21 is sent to the first connection pipe 8, the secondary-side switching mechanism 22 is brought into a third connection state where the second switching valve 22*b* is brought into the open state and the discharge side of the secondary-side compressor 21 is connected to the first connection pipe 8, and meanwhile, the fourth switching valve 22*d* is brought into the close state. Further, in the case where the refrigerant flowing through the first connection pipe 8 is sucked into the secondary-side compressor 21, the secondary-side switching mechanism 22 is brought into a fourth connection state where the fourth switching valve 22*d* is brought into the open state and the first connection pipe 8 is connected to the suction side of the secondary-side compressor 21, and meanwhile, the second switching valve 22*b* is brought into the close state.

The cascade heat exchanger 35 is a device for performing heat exchange between the refrigerant such as R32, which is the primary-side refrigerant, and carbon dioxide, which is the secondary-side refrigerant, without mixing the refrigerants with each other. The cascade heat exchanger 35 includes the secondary-side flow path 35*a* through which the secondary-side refrigerant of the secondary-side refrigerant circuit 10 flows, and the primary-side flow path 35*b* through which the primary-side refrigerant of the primary-side refrigerant circuit 5*a* flows, and thus is shared by the primary-side unit 5 and the heat source unit 2. In addition, in the present embodiment, the cascade heat exchanger 35 is disposed inside a not-shown casing of the heat source unit 2, and refrigerant pipes extending from both ends of the primary-side flow path 35*b* of the cascade heat exchanger 35 are provided so as to extend to the outside of the not-shown casing of the heat source unit 2.

The secondary-side expansion valve 36 is an electrically powered expansion valve whose opening degree can be controlled and is connected to the cascade heat exchanger 35 on the liquid side in order to perform control and the like of the flow rate of the secondary-side refrigerant flowing through the cascade heat exchanger 35.

The third shut-off valve 31, the first shut-off valve 32, and the second shut-off valve 33 are valves provided in corresponding connecting ports connected with external devices and pipes (specifically, the connection pipes 7, 8, and 9). Specifically, the third shut-off valve 31 is connected to the third connection pipe 7 drawn out from the heat source unit 2. The first shut-off valve 32 is connected to the first connection pipe 8 drawn out from the heat source unit 2. The second shut-off valve 33 is connected to the second connection pipe 9 drawn out from the heat source unit 2.

The first heat source pipe 28 is a refrigerant pipe that connects the first shut-off valve 32 to the secondary-side switching mechanism 22. Specifically, the first heat source pipe 28 connects the first shut-off valve 32 to a portion of the secondary-side switching mechanism 22 between the second switching valve 22*b* and the fourth switching valve 22*d*.

The suction flow path 23 is a flow path that connects the secondary-side switching mechanism 22 and the suction side of the secondary-side compressor 21. Specifically, the suction flow path 23 connects a portion of the secondary-side switching mechanism 22 between the third switching valve 22*c* and the fourth switching valve 22*d* to the suction side of the secondary-side compressor 21. The suction flow path 23 is provided in the middle with the accumulator 30.

The second heat source pipe 29 is a refrigerant pipe that connects the second shut-off valve 33 to the middle of the suction flow path 23. In addition, in the present embodiment, the second heat source pipe 29 is connected to the suction flow path 23 at a connection point Y which is a portion in the suction flow path 23 between the accumulator 30 and a portion between the second switching valve 22*b* and the fourth switching valve 22*d* in the secondary-side switching mechanism 22.

The discharge flow path 24 is a refrigerant pipe that connects the discharge side of the secondary-side compressor 21 to the secondary-side switching mechanism 22. Specifically, the discharge flow path 24 connects the discharge side of the secondary-side compressor 21 to a portion of the secondary-side switching mechanism 22 between the first switching valve 22*a* and the second switching valve 22*b*.

The third heat source pipe 25 is a refrigerant pipe that connects the secondary-side switching mechanism 22 to the gas side of the cascade heat exchanger 35. Specifically, the third heat source pipe 25 connects a portion of the secondary-side switching mechanism 22 between first switching valve 22*a* and the third switching valve 22*c* to the gas-side end of the secondary-side flow path 35*a* in the cascade heat exchanger 35.

The fourth heat source pipe 26 is a refrigerant pipe that connects the liquid side (the side opposite to the gas side, the side opposite to the side on which the secondary-side switching mechanism 22 is provided) of the cascade heat exchanger 35 to the secondary-side expansion valve 36. Specifically, the fourth heat source pipe 26 connects the liquid-side end (the end on the side opposite to the gas side) of the secondary-side flow path 35*a* in the cascade heat exchanger 35 to the secondary-side expansion valve 36.

The fifth heat source pipe 27 is a refrigerant pipe that connects the secondary-side expansion valve 36 to the third shut-off valve 31.

The accumulator 30 is a container that can store the secondary-side refrigerant, and is provided on the suction side of the secondary-side compressor 21.

The oil separator 34 is provided in the middle of the discharge flow path 24. The oil separator 34 is a device for separating a refrigerating machine oil from the secondary-side refrigerant, the oil being discharged from the secondary-side compressor 21 along with the secondary-side refrigerant, and for returning the oil to the secondary-side compressor 21.

The oil return circuit 40 is provided to connect the oil separator 34 to the suction flow path 23. The oil return circuit 40 includes an oil return flow path 41 in which a flow path extending from the oil separator 34 extends to join a portion of the suction flow path 23 between the accumulator 30 and the suction side of the secondary-side compressor 21. The oil return flow path 41 is provided in the middle with an oil return capillary tube 42 and an oil return on-off valve 44. By the oil return on-off valve 44 being controlled to be opened, the refrigerating machine oil separated in the oil separator 34 passes through the oil return capillary tube 42 of the oil return flow path 41 and is returned to the suction side of the secondary-side compressor 21. In the present embodiment, when the secondary-side compressor 21 is in the operating state in the secondary-side refrigerant circuit 10, the oil return on-off valve 44 repeats keeping the open state for a predetermined time and keeping the close state for a predetermined time, thereby controlling the amount of refrigerating machine oil returned through the oil return circuit 40. Note that, in the present embodiment, the oil return on-off valve 44 is an electromagnetic valve that is controlled to open and close, but a configuration may be adopted in which the oil return on-off valve 44 is an electrically powered expansion valve whose opening degree can be controlled, and meanwhile, the oil return capillary tube 42 is omitted.

The connection flow path 45 is provided to connect the fifth heat source pipe 27 to the suction flow path 23. The connection flow path 45 is provided to connect the fifth heat source pipe 27 and a portion of the suction flow path 23 between the secondary-side switching mechanism 22 and the accumulator 30. The connection flow path 45 is provided in the middle with a connection on-off valve 46. Note that, in the present embodiment, the connection on-off valve 46 is an electromagnetic valve that is controlled to open and close, but the connection on-off valve 46 may be an electrically powered expansion valve whose opening degree can be controlled. In the present embodiment, the connection on-off valve 46 is controlled to be opened during the stop of the cooling operation or the cooling dominant operation to be described later, and is kept closed during the normal operation when the secondary-side compressor 21 is driven. As described above, the pressure of the high-pressure refrigerant in the secondary-side refrigerant circuit 10 is reduced by bringing the connection on-off valve 46 to the open state during the stop of the cooling operation or the cooling dominant operation. As a result, during the stop of the secondary-side compressor 21, the pressure of the high-pressure refrigerant is prevented from becoming too high due to an increase in the temperature around the location where the high-pressure refrigerant is present in the secondary-side refrigerant circuit 10.

The bypass flow path 47 is provided to connect the third heat source pipe 25 to the suction flow path 23. The bypass flow path 47 is provided to connect the third heat source pipe 25 to a portion of the suction flow path 23 between the secondary-side switching mechanism 22 and the accumulator 30. The bypass flow path 47 is provided in the middle with a bypass capillary tube 48 (corresponding to a decompression mechanism) and a bypass on-off valve 49 (corresponding to an on-off valve). In the present embodiment, the bypass on-off valve 49 is controlled to be opened at the start of the heating operation or the heating dominant operation to be described later, and is kept closed during the normal operation when the secondary-side compressor 21 is driven. Note that, in the present embodiment, the bypass on-off valve 49 is an electromagnetic valve that is controlled to open and close, but a configuration may be adopted in which the bypass on-off valve 49 is an electrically powered expansion valve whose opening degree can be controlled, and meanwhile, the bypass capillary tube 48 is omitted.

Further, the heat source unit 2 is provided with various sensors. Specifically, there is provided a secondary-side suction pressure sensor 37 (corresponding to a sensor that detects the refrigerant pressure or the refrigerant temperature in the third flow path) that detects the pressure of the secondary-side refrigerant on the suction side of the secondary-side compressor 21, a secondary-side discharge pressure sensor 38 that detects the pressure of the secondary-side refrigerant on the discharge side of the secondary-side compressor 21, and a secondary-side discharge temperature sensor 39 that detects the temperature of the secondary-side refrigerant on the discharge side of the secondary-side compressor 21.

The heat source-side control unit 20 controls operation of the respective units 21 (21*a*), 22, 36, 44, 46, and 49 that constitute the heat source unit 2. Further, the heat source-side control unit 20 includes a processor such as a CPU and a microcomputer, and a memory, which are provided for controlling the heat source unit 2, and is configured to be able to exchange control signals and the like with the primary-side control unit 70 of the primary-side unit 5, utilization-side control units 50*a*, 50*b*, and 50*c* of the utilization units 3*a*, 3*b*, and 3*c*, and the branch unit control units 60*a*, 60*b*, and 60*c*.

(4) Control Unit

In the refrigeration cycle system 1, the heat source-side control unit 20, the utilization-side control units 50*a*, 50*b*, and 50*c*, the branch unit control units 60*a*, 60*b*, and 60*c*, and the primary-side control unit 70, which are described above, are communicably connected to each other in a wired or wireless manner to constitute a control unit 80. Therefore, this control unit 80 controls the operation of the respective units 21 (21*a*), 22, 36, 44, 46, 49, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), and 76 on the basis of detection information of the various sensors such as 37, 38, 39, 77, 78, 58*a*, 58*b*, and 58*c* and instruction information or the like received from a not-shown remote controller or the like.

(5) Operation of Refrigeration Cycle System

Next, the operation of the refrigeration cycle system 1 is described with reference to FIGS. 3 to 6.

The refrigeration cycle operation of the refrigeration cycle system 1 can be mainly classified into the cooling operation, the heating operation, the cooling dominant operation, and the heating dominant operation.

Here, the cooling operation is a refrigeration cycle operation in which only the utilization unit whose utilization-side heat exchanger functions as an evaporator for the refrigerant is available, and the cascade heat exchanger 35 is made to function as a radiator for the secondary-side refrigerant with respect to the evaporation load of the entire utilization unit.

The heating operation is a refrigeration cycle operation in which only the utilization unit whose utilization-side heat exchanger functions as a radiator for the refrigerant is available, and the cascade heat exchanger 35 is made to function as an evaporator for the secondary-side refrigerant with respect to the radiation load of the entire utilization unit.

The cooling dominant operation is an operation that uses, in combination, a utilization unit whose utilization-side heat exchanger functions as an evaporator for the refrigerant and a utilization unit whose utilization-side heat exchanger functions as a radiator for the refrigerant. The cooling dominant operation is a refrigeration cycle operation in which, in a case where the evaporation load is dominant among the heat load of the entire utilization unit, the cascade heat exchanger 35 is made to function as a radiator for the secondary-side refrigerant.

The heating dominant operation is an operation that uses, in combination, a utilization unit whose utilization-side heat exchanger functions as an evaporator for the refrigerant and a utilization unit whose utilization-side heat exchanger functions as a radiator for the refrigerant. The heating dominant operation is a refrigeration cycle operation in which, in a case where the radiation load is dominant among the heat load of the entire utilization unit, the cascade heat exchanger 35 is made to function as an evaporator for the secondary-side refrigerant.

Note that the operation of the refrigeration cycle system 1 including these refrigeration cycle operations is performed by the above-described control unit 80.

In any of these operations, any of the utilization units may be in an operation stop state. The utilization-side control units 50*a*, 50*b*, and 50*c* having received a command from a not-shown remote controller or the like control the utilization units 3*a*, 3*b*, and 3*c* to be in the operation stop state. In the operation stop state, the utilization units 3*a*, 3*b*, and 3*c* close the utilization-side expansion valves 51*a*, 51*b*, and 51*c* or close the first control valves 66*a*, 66*b*, and 66*c* and the second control valves 67*a*, 67*b*, and 67*c* before the indoor fans 53*a*, 53*b*, and 53*c* are stopped. As a result, the flow of the refrigerant in the utilization units 3*a*, 3*b*, and 3*c* in the operation stop state is stopped.

(5-1) Cooling Operation

Figure 3:
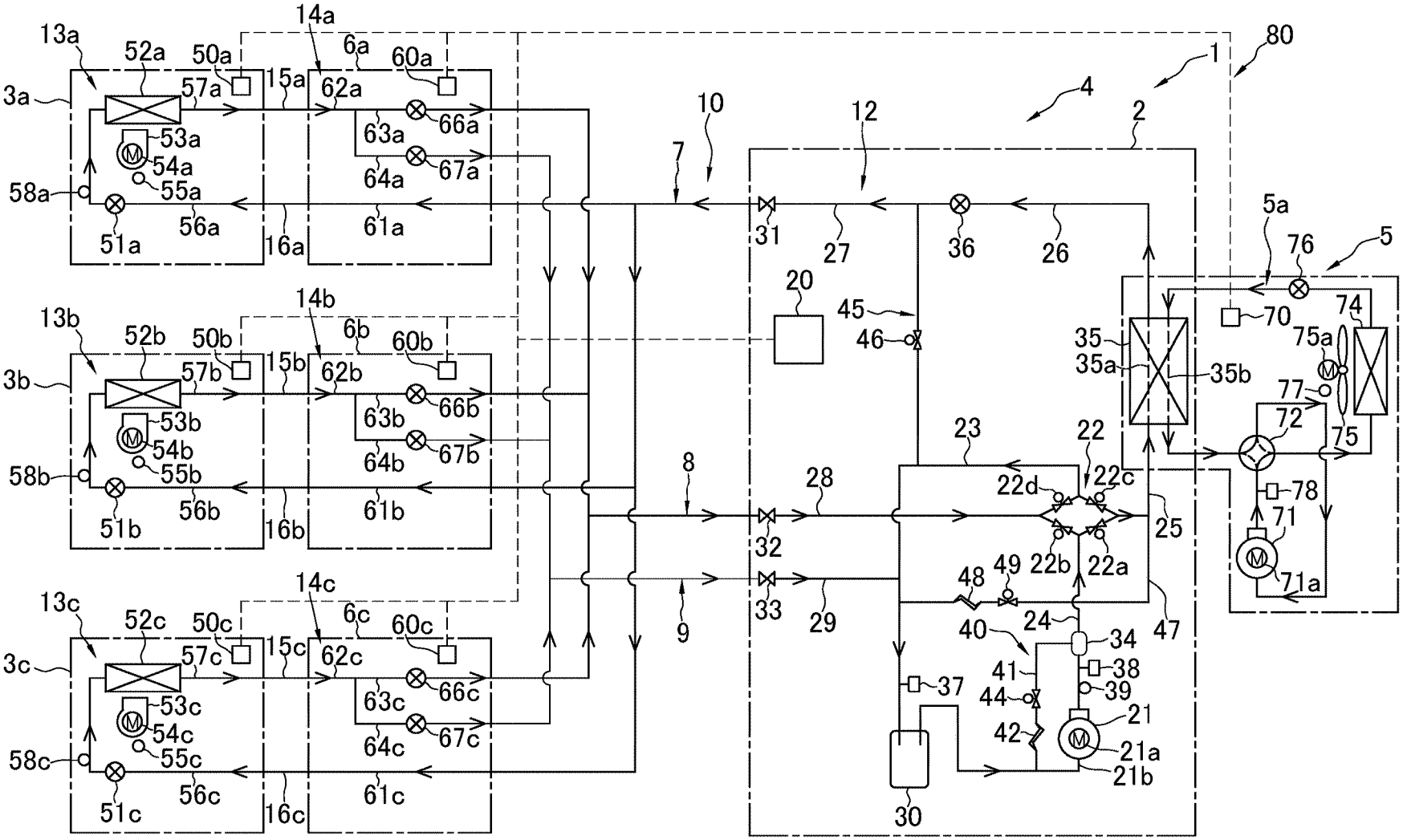
FIG. 3 is a diagram showing an operation (flow of a refrigerant) in a cooling operation of the refrigeration cycle system.

In the cooling operation, all of the utilization-side heat exchangers 52*a*, 52*b*, and 52*c* of the utilization units 3*a*, 3*b*, and 3*c* are operated to function as evaporators for the refrigerant, and the cascade heat exchanger 35 is operated to functions as a radiator for the secondary-side refrigerant. In this cooling operation, the primary-side refrigerant circuit 5*a* and the secondary-side refrigerant circuit 10 of the refrigeration cycle system 1 are configured as shown in FIG. 3. Arrows attached to the primary-side refrigerant circuit 5*a* and arrows attached to the secondary-side refrigerant circuit 10 in FIG. 3 indicate the flow of the refrigerant during the cooling operation.

Specifically, in the primary-side unit 5, the primary-side switching mechanism 72 is switched to the fifth connection state to cause the cascade heat exchanger 35 to function as an evaporator for the primary-side refrigerant. Note that the fifth connection state of the primary-side switching mechanism 72 is a connection state indicated by a solid line in the primary-side switching mechanism 72 in FIG. 3. As a result, in the primary-side unit 5, the primary-side refrigerant discharged from the primary-side compressor 71 passes through the primary-side switching mechanism 72, and is condensed by exchanging heat in the primary-side heat exchanger 74 with the outside air supplied from the primary-side fan 75. The primary-side refrigerant condensed in the primary-side heat exchanger 74 is decompressed in the primary-side expansion valve 76, flows through the primary-side flow path 35*b* of the cascade heat exchanger 35, evaporates, and is sucked into the primary-side compressor 71 via the primary-side switching mechanism 72.

In addition, in the heat source unit 2, the secondary-side switching mechanism 22 in the first connection state is switched to the fourth connection state to cause the cascade heat exchanger 35 to function as a radiator for the secondary-side refrigerant. Note that the first connection state of the secondary-side switching mechanism 22 is a connection state in which the first switching valve 22*a* is in the open state and the third switching valve 22*c* is in the close state. The fourth connection state of the secondary-side switching mechanism 22 is a connection state in which the fourth switching valve 22*d* is in the open state and the second switching valve 22*b* is in the close state. Here, the opening degree of the secondary-side expansion valve 36 is controlled. In the first to third utilization units 3*a*, 3*b*, and 3*c*, the first control valves 66*a*, 66*b*, and 66*c* and the second control valves 67*a*, 67*b*, and 67*c* are controlled to be opened. As a result, all of the utilization-side heat exchangers 52*a*, 52*b*, and 52*c* of the utilization units 3*a*, 3*b*, and 3*c* function as evaporators for the refrigerant. Further, all of the utilization-side heat exchangers 52*a*, 52*b*, and 52*c* of the utilization units 3*a*, 3*b*, and 3*c* are in the connected state to the suction side of the secondary-side compressor 21 of the heat source unit 2 via the first utilization pipes 57*a*, 57*b*, and 57*c*, the first connecting pipes 15*a*, 15*b*, and 15*c*, the junction pipes 62*a*, 62*b*, and 62*c*, the first branch pipes 63*a*, 63*b*, and 63*c*, the second branch pipes 64*a*, 64*b*, and 64*c*, the first connection pipe 8, and the second connection pipe 9. In the utilization units 3*a*, 3*b*, and 3*c*, the opening degrees of the utilization-side expansion valves 51*a*, 51*b*, and 51*c* are controlled. Note that, in the cooling operation, the plurality of utilization units 3*a*, 3*b*, and 3*c* may include the utilization unit in the operation stop state.

In the secondary-side refrigerant circuit 10 as described above, the high-pressure secondary-side refrigerant compressed and discharged by the secondary-side compressor 21 is sent to the secondary-side flow path 35*a* of the cascade heat exchanger 35 through the secondary-side switching mechanism 22. In the cascade heat exchanger 35, the high-pressure secondary-side refrigerant flowing through the secondary-side flow path 35*a* radiates heat, and the primary-side refrigerant flowing through the primary-side flow path 35*b* of the cascade heat exchanger 35 evaporates. The secondary-side refrigerant that has dissipated heat in the cascade heat exchanger 35 passes through the secondary-side expansion valve 36 whose opening degree is controlled, and then is sent to the third connection pipe 7 through the third shut-off valve 31.

Then, the refrigerant sent to the third connection pipe 7 is branched into three and passes through the third branch pipes 61*a*, 61*b*, and 61*c* of the first to third branch units 6*a* 6*b*, and 6*c*. Thereafter, the refrigerant having flowed through the second connecting pipes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization-side expansion valves 51*a*, 51*b*, and 51*c* of the utilization units 3*a*, 3*b*, and 3*c*.

Then, the refrigerant having passed through the utilization-side expansion valves 51*a*, 51*b*, and 51*c* whose opening degrees are controlled exchanges heat with the indoor air supplied by the indoor fans 53*a*, 53*b*, and 53*c* in the utilization-side heat exchangers 52*a*, 52*b*, and 52*c*. As a result, the refrigerant flowing through the utilization-side heat exchangers 52*a*, 52*b*, and 52*c* evaporates and becomes a low-pressure gas refrigerant. The indoor air is cooled and is supplied into the room. As a result, the indoor space is cooled. The low-pressure gas refrigerant evaporated in the utilization-side heat exchangers 52*a*, 52*b*, and 52*c* flows through the first utilization pipes 57*a*, 57*b*, and 57*c*, flows through the first connecting pipes 15*a*, 15*b*, and 15*c*, and then is sent to the junction pipes 62*a*, 62*b*, and 62*c* of the first to third branch units 6*a*, 6*b*, and 6*c*.

Then, the low-pressure gas refrigerant sent to the junction pipes 62*a*, 62*b*, and 62*c* branches and flows into the first branch pipes 63*a*, 63*b*, and 63*c* and the second branch pipes 64*a*, 64*b*, and 64*c*. The refrigerant having passed through the first control valve 66*a*, 66*b*, and 66*c* in the first branch pipe 63*a*, 63*b*, and 63*c* is sent to the first connection pipe 8. The refrigerant having passed through the second control valve 67*a*, 67*b*, and 67*c* in the second branch pipe 64*a*, 64*b*, and 64*c* is sent to the second connection pipe 9.

Thereafter, the low-pressure gas refrigerant sent to the first connection pipe 8 and the second connection pipe 9 is returned to the suction side of the secondary-side compressor 21 through the first shut-off valve 32, the second shut-off valve 33, the first heat source pipe 28, the second heat source pipe 29, the secondary-side switching mechanism 22, the suction flow path 23, and the accumulator 30.

In this manner, the cooling operation is performed.

(5-2) Heating Operation

Figure 4:
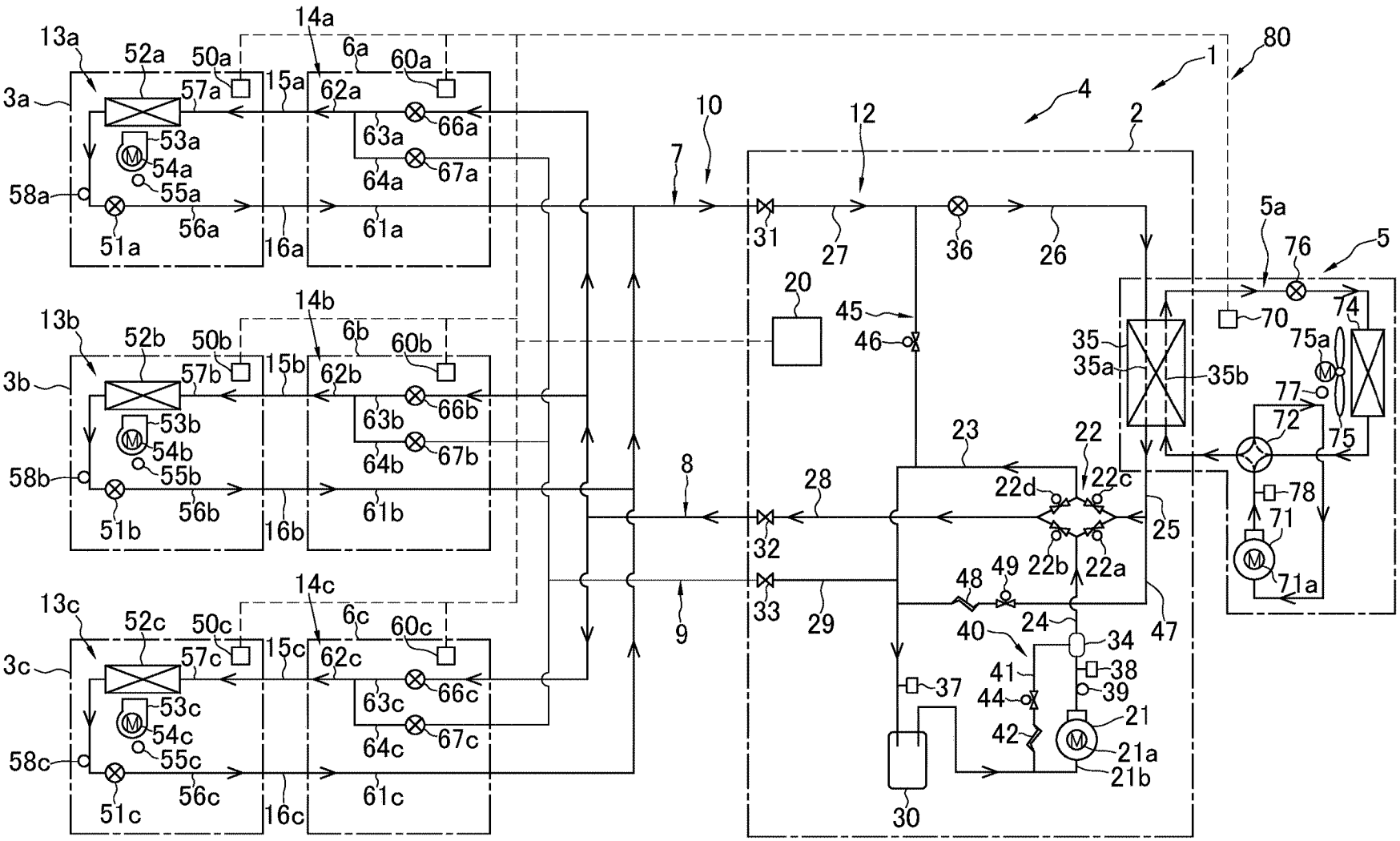
FIG. 4 is a diagram showing an operation (flow of the refrigerant) in a heating operation of the refrigeration cycle system.

In the heating operation, for example, all of the utilization-side heat exchangers 52*a*, 52*b*, and 52*c* of the utilization units 3*a*, 3*b*, and 3*c* function as radiators for the refrigerant. In the heating operation, the cascade heat exchanger 35 functions as an evaporator for the secondary-side refrigerant. In the heating operation, the primary-side refrigerant circuit 5*a* and the secondary-side refrigerant circuit 10 of the refrigeration cycle system 1 are configured as shown in FIG. 4. Arrows attached to the primary-side refrigerant circuit 5*a* and arrows attached to the secondary-side refrigerant circuit 10 in FIG. 4 indicate the flow of the refrigerant during the heating operation.

Specifically, in the primary-side unit 5, the primary-side switching mechanism 72 is switched to a sixth connection state to cause the cascade heat exchanger 35 to function as a radiator for the primary-side refrigerant. The sixth connection state of the primary-side switching mechanism 72 is a connection state indicated by a broken line in the primary-side switching mechanism 72 in FIG. 4. As a result, in the primary-side unit 5, the primary-side refrigerant discharged from the primary-side compressor 71 passes through the primary-side switching mechanism 72, and is condensed after passing through the primary-side flow path 35*b* of the cascade heat exchanger 35. The primary-side refrigerant having condensed in the cascade heat exchanger 35 is decompressed in the primary-side expansion valve 76, evaporates by exchanging heat with the outside air supplied from the primary-side fan 75 in the primary-side heat exchanger 74, and is sucked into the primary-side compressor 71 via the primary-side switching mechanism 72.

In addition, in the heat source unit 2, the secondary-side switching mechanism 22 in the second connection state is switched to the third connection state. The cascade heat exchanger 35 is thus made to function as an evaporator for the secondary-side refrigerant. The second connection state of the secondary-side switching mechanism 22 is a connection state in which the first switching valve 22*a* is in the close state and the third switching valve 22*c* is in the open state. The third connection state of the secondary-side switching mechanism 22 is a connection state in which the second switching valve 22*b* is in the open state and the fourth switching valve 22*d* is in the close state. In addition, the opening degree of the secondary-side expansion valve 36 is controlled. In the first to third branch units 6*a*, 6*b*, and 6*c*, the first control valves 66*a*, 66*b*, and 66*c* are controlled to be opened and the second control valves 67*a*, 67*b*, and 67*c* are controlled to be closed. As a result, all of the utilization-side heat exchangers 52*a*, 52*b*, and 52*c* of the utilization units 3*a*, 3*b*, and 3*c* function as radiators for the refrigerant. Further, the utilization-side heat exchangers 52*a*, 52*b*, and 52*c* of the utilization units 3*a*, 3*b*, and 3*c* are in the connected state to the discharge side of the secondary-side compressor 21 of the heat source unit 2 via the discharge flow path 24, the first heat source pipe 28, the first connection pipe 8, the first branch pipes 63*a*, 63*b*, and 63*c*, the junction pipes 62*a*, 62*b*, and 62*c*, the first connecting pipes 15*a*, 15*b*, and 15*c*, and the first utilization pipes 57*a*, 57*b*, and 57*c*. In the utilization units 3*a*, 3*b*, and 3*c*, the opening degrees of the utilization-side expansion valves Ma, Mb, and Mc are controlled. Note that, in the heating operation, the plurality of utilization units 3*a*, 3*b*, and 3*c* may include the utilization unit in the operation stop state.

In the secondary-side refrigerant circuit 10 as described above, the high-pressure refrigerant compressed and discharged by the secondary-side compressor 21 is sent to the first heat source pipe 28 through the second switching valve 22*b* controlled to be opened in the secondary-side switching mechanism 22. The refrigerant sent to the first heat source pipe 28 is sent to the first connection pipe 8 through the first shut-off valve 32.

Then, the high-pressure refrigerant sent to the first connection pipe 8 is branched into three and sent to the first branch pipes 63*a*, 63*b*, and 63*c* of the utilization units 3*a*, 3*b*, and 3*c*. The high-pressure refrigerant sent to the first branch pipes 63*a*, 63*b*, and 63*c* passes through the first control valves 66*a*, 66*b*, and 66*c*, and flows through the junction pipes 62*a*, 62*b*, and 62*c*. Thereafter, the refrigerant having flowed through the first connecting pipes 15*a*, 15*b*, and 15*c* and the first utilization pipes 57*a*, 57*b*, and 57*c* is sent to the utilization-side heat exchangers 52*a*, 52*b*, and 52*c*.

Then, the high-pressure refrigerant sent to the utilization-side heat exchangers 52*a*, 52*b*, and 52*c* exchanges heat in the utilization-side heat exchangers 52*a*, 52*b*, and 52*c* with the indoor air supplied from the indoor fans 53*a*, 53*b*, and 53*c*. As a result, the refrigerant flowing through the utilization-side heat exchangers 52*a*, 52*b*, and 52*c* radiates heat. The indoor air is heated and is supplied into the room. As a result, the indoor space is heated. Then, the refrigerant having radiated heat in the utilization-side heat exchangers 52*a*, 52*b*, and 52*c* flows through the second utilization pipes 56*a*, 56*b*, and 56*c*, and passes through the utilization-side expansion valves 51*a*, 51*b*, and 51*c* each of whose opening degree is controlled. Thereafter, the refrigerant having flowed through the second connecting pipes 16*a*, 16*b*, and 16*c* flows through the third branch pipes 61*a*, 61*b*, and 61*c* of the respective branch units 6*a*, 6*b*, and 6*c*.

Then, the flows of the refrigerant sent to the third branch pipes 61*a*, 61*b*, and 61*c* are sent to the third connection pipe 7 to be joined together.

The refrigerant then sent to the third connection pipe 7 is sent to the secondary-side expansion valve 36 through the third shut-off valve 31. The refrigerant sent to the secondary-side expansion valve 36 is subjected to flow rate control in the secondary-side expansion valve 36 and is then sent to the cascade heat exchanger 35. In the cascade heat exchanger 35, the secondary-side refrigerant flowing through the secondary-side flow path 35*a* evaporates to become the low-pressure gas refrigerant and is sent to the secondary-side switching mechanism 22, and the primary-side refrigerant flowing through the primary-side flow path 35*b* of the cascade heat exchanger 35 condenses. Then, the low-pressure secondary-side gas refrigerant sent to the secondary-side switching mechanism 22 is returned to the suction side of the secondary-side compressor 21 through the suction flow path 23 and the accumulator 30.

In this manner, the heating operation is performed.

(5-3) Cooling Dominant Operation

Figure 5:
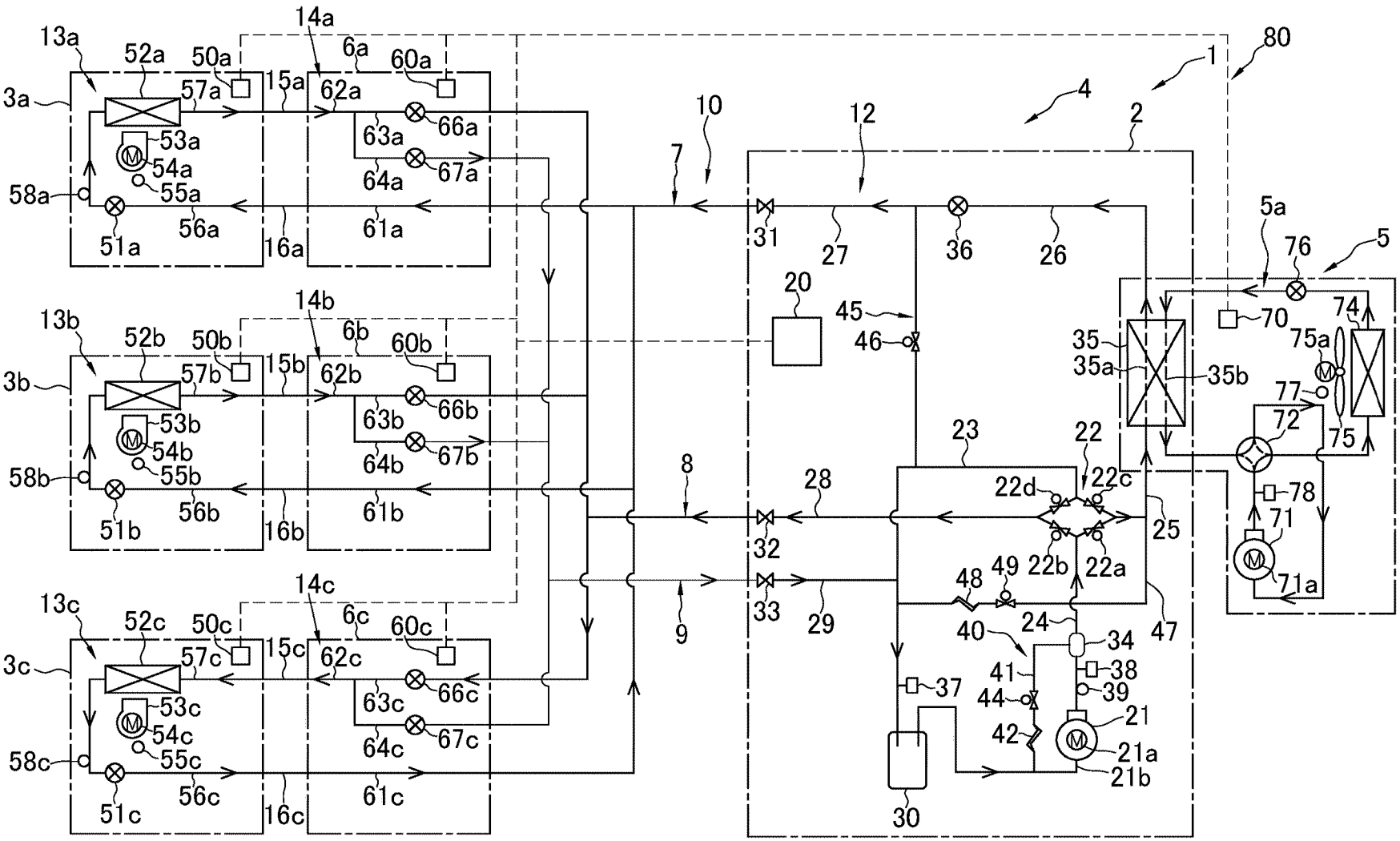
FIG. 5 is a diagram showing an operation (flow of the refrigerant) in a cooling and heating simultaneous operation (cooling dominant) in the refrigeration cycle system.

The cooling dominant operation is an operation in which, for example, the utilization-side heat exchangers 52*a* and 52*b* of the utilization units 3*a* and 3*b* function as evaporators for the refrigerant and the utilization-side heat exchanger 52*c* of the utilization unit 3*c* functions as a radiator for the refrigerant. In the cooling dominant operation, the cascade heat exchanger 35 functions as a radiator for the secondary-side refrigerant. In this cooling dominant operation, the primary-side refrigerant circuit 5*a* and the secondary-side refrigerant circuit 10 of the refrigeration cycle system 1 are configured as shown in FIG. 5. Arrows attached to the primary-side refrigerant circuit 5*a* and arrows attached to the secondary-side refrigerant circuit 10 in FIG. 5 indicate the flow of the refrigerant during the cooling dominant operation.

Specifically, in the primary-side unit 5, the primary-side switching mechanism 72 is switched to the fifth connection state (the state indicated by a solid line of the primary-side switching mechanism 72 in FIG. 5) to cause the cascade heat exchanger 35 to function as an evaporator for the primary-side refrigerant. As a result, in the primary-side unit 5, the primary-side refrigerant discharged from the primary-side compressor 71 passes through the primary-side switching mechanism 72, and is condensed by exchanging heat in the primary-side heat exchanger 74 with the outside air supplied from the primary-side fan 75. The primary-side refrigerant condensed in the primary-side heat exchanger 74 is decompressed in the primary-side expansion valve 76, flows through the primary-side flow path 35*b* of the cascade heat exchanger 35, evaporates, and is sucked into the primary-side compressor 71 via the primary-side switching mechanism 72.

In addition, in the heat source unit 2, the secondary-side switching mechanism 22 in the first connection state (in which the first switching valve 22*a* is in the open state and the third switching valve 22*c* is in the close state) is switched to the third connection state (in which the second switching valve 22*b* is in the open state and the fourth switching valve 22*d* is in the close state) to cause the cascade heat exchanger 35 to function as a radiator for the secondary-side refrigerant. In addition, the opening degree of the secondary-side expansion valve 36 is controlled. In the first to third branch units 6*a*, 6*b*, and 6*c*, the first control valve 66*c* and the second control valves 67*a* and 67*b* are controlled to be opened, and the first control valves 66*a* and 66*b* and the second control valve 67*c* are controlled to be closed. As a result, the utilization-side heat exchangers 52*a* and 52*b* of the utilization units 3*a* and 3*b* function as evaporators for the refrigerant and the utilization-side heat exchanger 52*c* of the utilization unit 3*c* functions as a radiator for the refrigerant. Further, the utilization-side heat exchangers 52*a* and 52*b* of the utilization units 3*a* and 3*b* are in the connected state to the suction side of the secondary-side compressor 21 of the heat source unit 2 via the second connection pipe 9, and the utilization-side heat exchanger 52*c* of the utilization unit 3*c* is in the connected state to the discharge side of the secondary-side compressor 21 of the heat source unit 2 via the first connection pipe 8. In the utilization units 3*a*, 3*b*, and 3*c*, the opening degrees of the utilization-side expansion valves 51*a*, 51*b*, and 51*c* are controlled. Note that, in the cooling dominant operation, the plurality of utilization units 3*a*, 3*b*, and 3*c* may include the utilization unit in the operation stop state.

In the above configured secondary-side refrigerant circuit 10, a part of the high-pressure secondary-side refrigerant compressed and discharged by the secondary-side compressor 21 is sent to the first connection pipe 8 through the secondary-side switching mechanism 22, the first heat source pipe 28, and the first shut-off valve 32, and the rest of the refrigerant is sent to the secondary-side flow path 35*a* of the cascade heat exchanger 35 through the secondary-side switching mechanism 22 and the third heat source pipe 25.

Then, the high-pressure refrigerant sent to the first connection pipe 8 is sent to the first branch pipe 63*c*. The high-pressure refrigerant sent to the first branch pipe 63*c* is sent to the utilization-side heat exchanger 52*c* of the utilization unit 3*c* through the first control valve 66*c* and the junction pipe 62*c*.

Then, the high-pressure refrigerant sent to the utilization-side heat exchanger 52*c* exchanges heat in the utilization-side heat exchanger 52*c* with the indoor air supplied from the indoor fan 53*c*. As a result, the refrigerant flowing through the utilization-side heat exchangers 52*c* radiates heat. The indoor air is heated and supplied into the room, and the heating operation of the utilization unit 3*c* is performed. The refrigerant having dissipated heat in the utilization-side heat exchanger 52*c* flows through the second utilization pipe 56*c*, and is subjected to flow rate control in the utilization-side expansion valve 51*c*. Thereafter, the refrigerant having flowed through the second connecting pipe 16*c* is sent to the third branch pipe 61*c* of the branch unit 6*c*.

Then, the refrigerant sent to the third branch pipe 61*c* is sent to the third connection pipe 7.

Further, the high-pressure refrigerant sent to the secondary-side flow path 35*a* of the cascade heat exchanger 35 radiates heat in the cascade heat exchanger 35 by exchanging heat with the primary-side refrigerant flowing through the primary-side flow path 35*b*. The secondary-side refrigerant having dissipated heat in the cascade heat exchanger 35 is subjected to flow rate control in the secondary-side expansion valve 36, and then is sent to the third connection pipe 7 through the third shut-off valve 31, and joins the refrigerant having dissipated heat in the utilization-side heat exchanger 52*c*.

Then, the refrigerant joined in the third connection pipe 7 is branched into two and is sent to the third branch pipes 61*a* and 61*b* of the branch units 6*a* and 6*b*. Thereafter, the refrigerant having flowed through the second connecting pipes 16*a* and 16*b* is sent to the second utilization pipes 56*a* and 56*b* of the first and second utilization units 3*a* and 3*b*. The refrigerant flowing through the second utilization pipes 56*a* and 56*b* is sent to the utilization-side expansion valves 51*a* and 51*b* of the utilization units 3*a* and 3*b*.

Then, the refrigerant having passed through the utilization-side expansion valves 51*a* and 51*b* whose opening degrees are controlled exchanges heat in the utilization-side heat exchangers 52*a* and 52*b* with the indoor air supplied by the indoor fans 53*a* and 53*b*. As a result, the refrigerant flowing through the utilization-side heat exchangers 52*a* and 52*b* evaporates and becomes a low-pressure gas refrigerant. The indoor air is cooled and is supplied into the room. As a result, the indoor space is cooled. The low-pressure gas refrigerant evaporated in the utilization-side heat exchangers 52*a* and 52*b* is sent to the junction pipes 62*a* and 62*b* of the first and second branch units 6*a* and 6*b*.

Then, the flows of the low-pressure gas refrigerant sent to the junction pipes 62*a* and 62*b* are sent to the second connection pipe 9 through the second control valves 67*a* and 67*b* and the second branch pipes 64*a* and 64*b* to be joined together.

Thereafter, the low-pressure gas refrigerant sent to the second connection pipe 9 is returned to the suction side of the secondary-side compressor 21 through the second shut-off valve 33, the second heat source pipe 29, the suction flow path 23, and the accumulator 30.

In this manner, the cooling dominant operation is performed.

(5-4) Heating Dominant Operation

Figure 6:
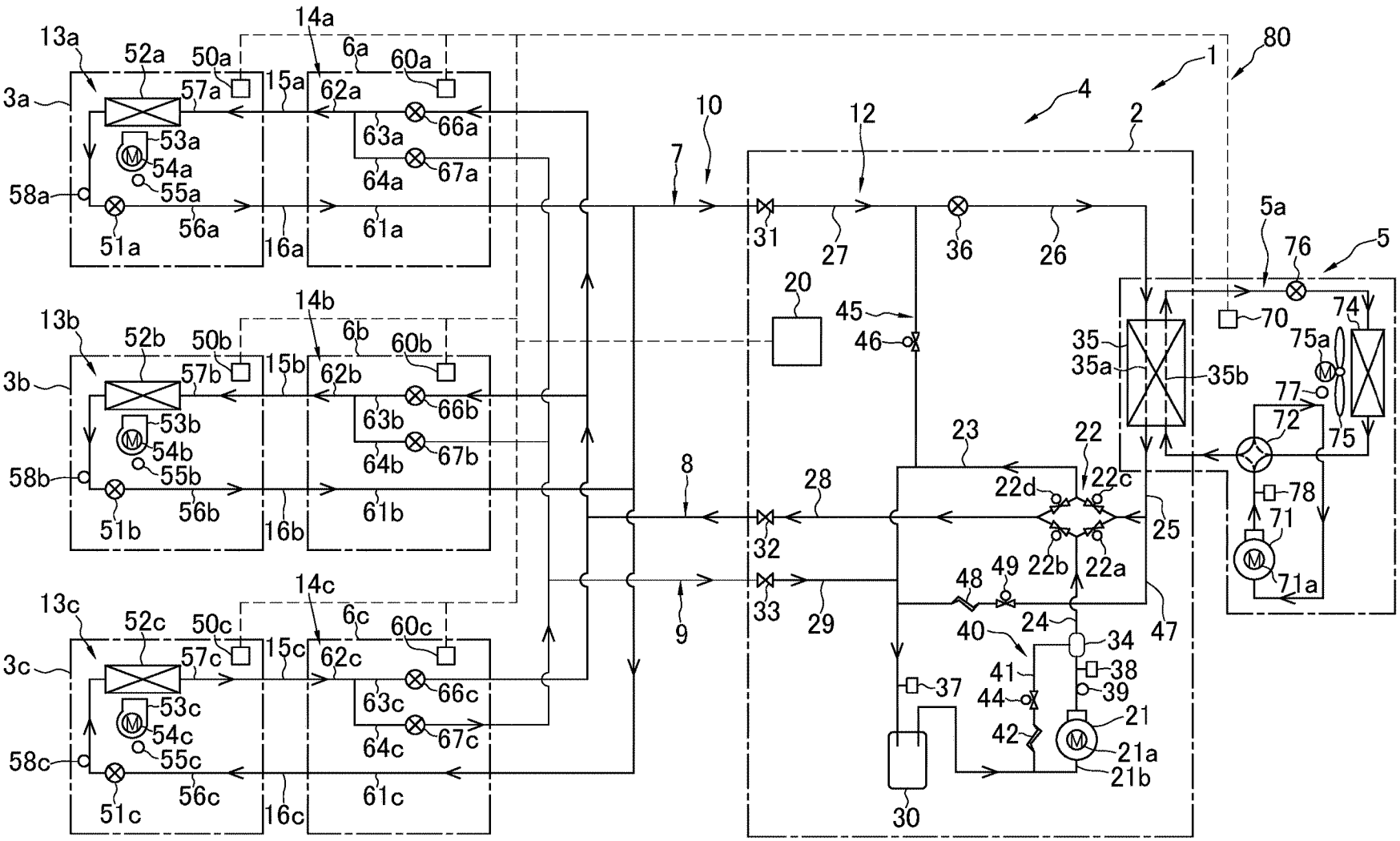
FIG. 6 is a diagram showing an operation (flow of the refrigerant) in the cooling and heating simultaneous operation (heating dominant) in the refrigeration cycle system.

The heating dominant operation is an operation in which, for example, the utilization-side heat exchangers 52*a* and 52*b* of the utilization units 3*a* and 3*b* function as radiators for the refrigerant and the utilization-side heat exchanger 52*c* functions as an evaporator for the refrigerant. In the heating dominant operation, the cascade heat exchanger 35 functions as an evaporator for the secondary-side refrigerant. In the heating dominant operation, the primary-side refrigerant circuit 5*a* and the secondary-side refrigerant circuit 10 of the refrigeration cycle system 1 are configured as shown in FIG. 6. Arrows attached to the primary-side refrigerant circuit 5*a* and arrows attached to the secondary-side refrigerant circuit 10 in FIG. 6 indicate the flow of the refrigerant during the heating dominant operation.

Specifically, in the primary-side unit 5, the primary-side switching mechanism 72 is switched to the sixth connection state to cause the cascade heat exchanger 35 to function as a radiator for the primary-side refrigerant. The sixth connection state of the primary-side switching mechanism 72 is a connection state indicated by a broken line in the primary-side switching mechanism 72 in FIG. 6. As a result, in the primary-side unit 5, the primary-side refrigerant discharged from the primary-side compressor 71 passes through the primary-side switching mechanism 72, and is condensed after passing through the primary-side flow path 35*b* of the cascade heat exchanger 35. The primary-side refrigerant having condensed in the cascade heat exchanger 35 is decompressed in the primary-side expansion valve 76, evaporates by exchanging heat with the outside air supplied from the primary-side fan 75 in the primary-side heat exchanger 74, and is sucked into the primary-side compressor 71 via the primary-side switching mechanism 72.

In addition, in the heat source unit 2, the secondary-side switching mechanism 22 in the second connection state is switched to the third connection state. The second connection state of the secondary-side switching mechanism 22 is a connection state in which the first switching valve 22*a* is in the close state and the third switching valve 22*c* is in the open state. The third connection state of the secondary-side switching mechanism 22 is a connection state in which the second switching valve 22*b* is in the open state and the fourth switching valve 22*d* is in the close state. The cascade heat exchanger 35 is thus made to function as an evaporator for the secondary-side refrigerant. In addition, the opening degree of the secondary-side expansion valve 36 is controlled. In the first to third branch units 6*a*, 6*b*, and 6*c*, the first control valves 66*a* and 66*b* and the second control valve 67*c* are controlled to be opened, and the first control valve 66*c* and the second control valves 67*a* and 67*b* are controlled to be closed. As a result, the utilization-side heat exchangers 52*a* and 52*b* of the utilization units 3*a* and 3*b* function as radiators for the refrigerant and the utilization-side heat exchanger 52*c* of the utilization unit 3*c* functions as an evaporator for the refrigerant. Further, the utilization-side heat exchanger 52*c* of the utilization unit 3*c* is in the connected state to the suction side of the secondary-side compressor 21 of the heat source unit 2 via the first utilization pipe 57*c*, the first connecting pipe 15*c*, the junction pipe 62*c*, the second branch pipe 64*c*, and the second connection pipe 9. Further, the utilization-side heat exchangers 52*a* and 52*b* of the utilization units 3*a* and 3*b* are in the connected state to the discharge side of the secondary-side compressor 21 of the heat source unit 2 via the discharge flow path 24, the first heat source pipe 28, the first connection pipe 8, the first branch pipes 63*a* and 63*b*, the junction pipes 62*a* and 62*b*, the first connecting pipes 15*a* and 15*b*, and the first utilization pipes 57*a* and 57*b*. In the utilization units 3*a*, 3*b*, and 3*c*, the opening degrees of the utilization-side expansion valves 51*a*, 51*b*, and 51*c* are controlled. Note that, in the heating dominant operation, the plurality of utilization units 3*a*, 3*b*, and 3*c* may include the utilization unit in the operation stop state.

In the secondary-side refrigerant circuit 10 as described above, the high-pressure secondary-side refrigerant compressed and discharged by the secondary-side compressor 21 is sent to the first connection pipe 8 through the secondary-side switching mechanism 22, the first heat source pipe 28, and the first shut-off valve 32.

The high-pressure refrigerant sent to the first connection pipe 8 is then branched into two and sent to the first branch pipes 63*a* and 63*b* of the first branch unit 6*a* and the second branch unit 6*b* respectively connected to the first utilization unit 3*a* and the second utilization unit 3*b* which are the utilization units in operation. The high-pressure refrigerant sent to the first branch pipes 63*a* and 63*b* is sent to the utilization-side heat exchangers 52*a* and 52*b* of the first utilization unit 3*a* and the second utilization unit 3*b* through the first control valves 66*a* and 66*b*, the junction pipes 62*a* and 62*b*, and the first connecting pipes 15*a* and 15*b*.

Then, the high-pressure refrigerant sent to the utilization-side heat exchangers 52*a* and 52*b* exchanges heat in the utilization-side heat exchangers 52*a* and 52*b* with the indoor air supplied from the indoor fans 53*a* and 53*b*. As a result, the refrigerant flowing through the utilization-side heat exchangers 52*a* and 52*b* radiates heat. The indoor air is heated and is supplied into the room. As a result, the indoor space is heated. Then, the refrigerant having radiated heat in the utilization-side heat exchangers 52*a* and 52*b* flows through the second utilization pipes 56*a* and 56*b*, and passes through the utilization-side expansion valves 51*a* and 51*b* each of whose opening degree is controlled. The refrigerant having passed through the second connecting pipes 16*a* and 16*b* is sent to the third connection pipe 7 via the third branch pipes 61*a* and 61*b* of the branch units 6*a* and 6*b*.

A part of the refrigerant sent to the third connection pipe 7 is then sent to the third branch pipe 61*c* of the branch unit 6*c*, and the rest of the refrigerant is sent to the secondary-side expansion valve 36 through the third shut-off valve 31.

Then, the refrigerant having flowed through the third branch pipe 61*c* flows through the second utilization pipe 56*c* of the utilization unit 3*c* via the second connecting pipe 16*c*, and is sent to the utilization-side expansion valve 51*c*.

Then, the refrigerant having passed through the utilization-side expansion valve 51*c* whose opening degree is controlled exchanges heat in the utilization-side heat exchanger 52*c* with the indoor air supplied by the indoor fan 53*c*. As a result, the refrigerant flowing through the utilization-side heat exchanger 52*c* evaporates and becomes a low-pressure gas refrigerant. The indoor air is cooled and is supplied into the room. As a result, the indoor space is cooled. The low-pressure gas refrigerant having evaporated in the utilization-side heat exchanger 52*c* passes through the first utilization pipe 57*c* and the first connecting pipe 15*c*, and is sent to the junction pipe 62*c*.

Then, the low-pressure gas refrigerant sent to the junction pipe 62*c* is sent to the second connection pipe 9 through the second control valve 67*c* and the second branch pipe 64*c*.

Thereafter, the low-pressure gas refrigerant sent to the second connection pipe 9 is returned to the suction side of the secondary-side compressor 21 through the second shut-off valve 33, the second heat source pipe 29, the suction flow path 23, and the accumulator 30.

Further, the refrigerant sent to the secondary-side expansion valve 36 passes through the secondary-side expansion valve 36 whose opening degree is controlled, and in the secondary-side flow path 35*a* in the cascade heat exchanger 35, performs heat exchange with the primary-side refrigerant flowing through the primary-side flow path 35*b*. As a result, the refrigerant flowing through the secondary-side flow path 35*a* of the cascade heat exchanger 35 evaporates to become a low-pressure gas refrigerant, and is sent to the secondary-side switching mechanism 22. The low-pressure gas refrigerant sent to the secondary-side switching mechanism 22 joins together in the suction flow path 23 with the low-pressure gas refrigerant evaporated in the utilization-side heat exchanger 52*c*. The joined refrigerant is returned to the suction side of the secondary-side compressor 21 via the accumulator 30.

In this manner, the heating dominant operation is performed.

(6) Start-Up Control

Figure 7:
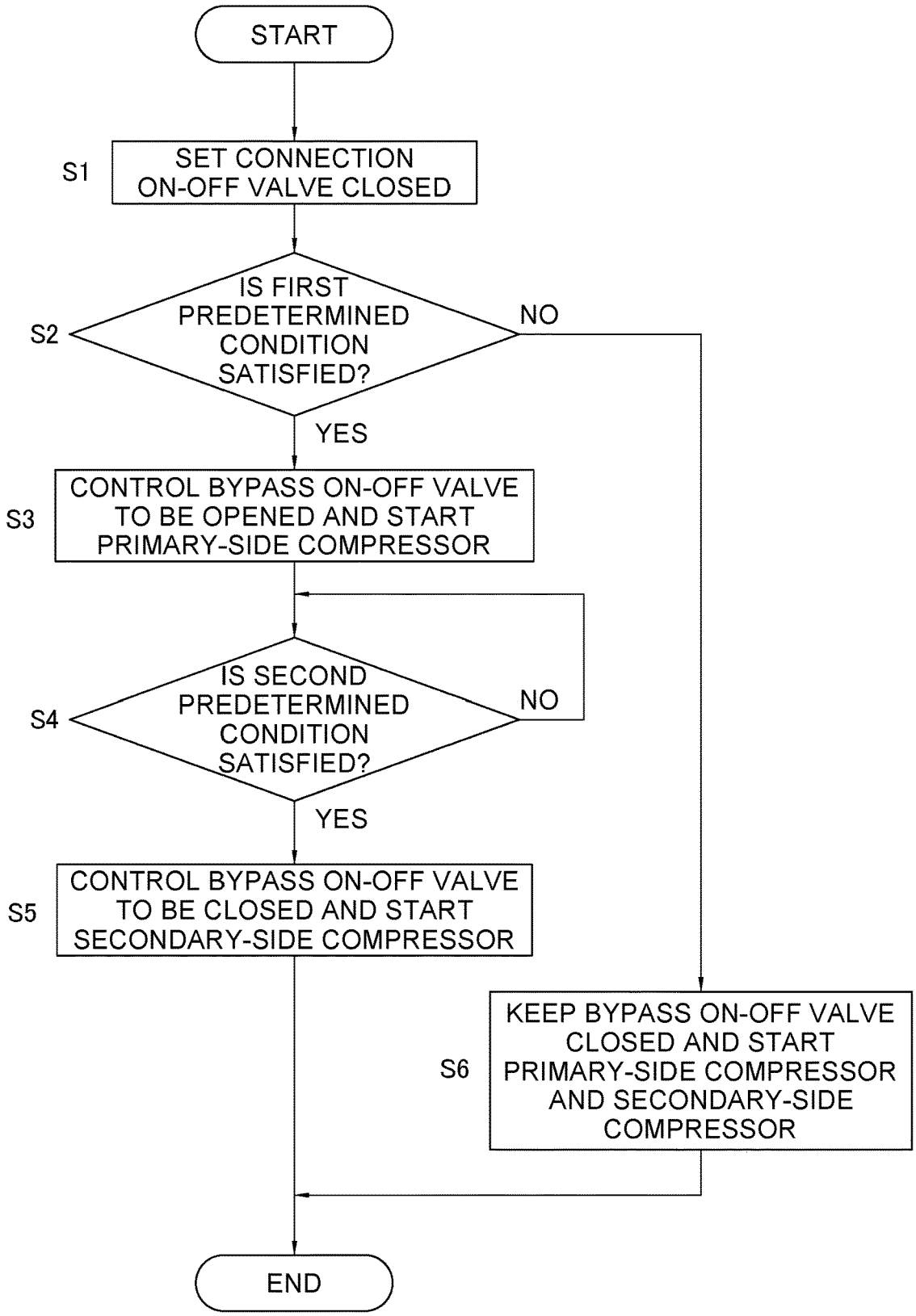
FIG. 7 is a start-up control flowchart of the refrigeration cycle system.

Hereinafter, start-up control of the refrigeration cycle system 1 is described with reference to a flowchart in FIG. 7.

Here, the start-up control of the heat source unit 2 and the primary-side unit 5 performed at the start of the cooling operation or at the start of the cooling dominant operation is described. The control unit 80 starts the start-up control when a start-up instruction from a not-shown remote controller is received or the like.

In step S1, the control unit 80 controls the connection on-off valve 46, which is in the open state during the stop of the cooling operation or the cooling dominant operation, to be closed.

In step S2, the control unit 80 determines whether or not a first predetermined condition for starting the start-up control is met. Here, the first predetermined condition is not limited, but may be, for example, a condition determined to be satisfied when the temperature of the refrigerant in the suction flow path 23, the outside air temperature, or the like is a predetermined temperature or more. Note that, in the case where the determination is made using the temperature of the refrigerant in the suction flow path 23, a pressure-equivalent saturation temperature derived from the pressure detected by the secondary-side suction pressure sensor 37 may be used. In addition, in the case where the determination is made using the outside air temperature, the temperature detected by the outside air temperature sensor 77 may be used. Here, if the first predetermined condition is satisfied, the process proceeds to step S3. Alternatively, if the first predetermined condition is not satisfied, the process proceeds to step S6.

In step S3, for the primary-side unit 5, the control unit 80 starts the primary-side compressor 71 while bringing the primary-side switching mechanism 72 into the fifth connection state (see the solid line of the primary-side switching mechanism 72 in FIG. 1). Further, for the secondary-side unit 4, the control unit 80 controls the bypass on-off valve 49 to be opened while keeping the secondary-side compressor 21 in the stop state. Note that the control unit 80 keeps the oil return on-off valve 44 closed.

In step S4, the control unit 80 determines whether or not a second predetermined condition is met. The second predetermined condition may be a condition satisfied when the pressure detected by the secondary-side suction pressure sensor 37 is a predetermined pressure or less, a condition satisfied when the time elapsed from the start of the process of step S3 exceeds a predetermined time, or a condition satisfied when either or both of the above conditions are satisfied. Here, if the second predetermined condition is satisfied, the process proceeds to step S5. Alternatively, if the second predetermined condition is not satisfied, step S4 is repeated.

In step S5, the control unit 80 starts the secondary-side compressor 21 while setting the connection state of the secondary-side switching mechanism 22 to the connection state corresponding to the cooling operation or the cooling dominant operation described above. In addition, the control unit 80 controls the bypass on-off valve 49 to be closed. The control unit 80 thus ends the start-up control, and thereafter executes the cooling operation or the cooling dominant operation described above.

In step S6, for the primary-side unit 5, the control unit 80 starts the primary-side compressor 71 while bringing the primary-side switching mechanism 72 into the fifth connection state. Further, for the secondary-side unit 4, the control unit 80 starts the secondary-side compressor 21 while keeping the bypass on-off valve 49 closed and setting the connection state of the secondary-side switching mechanism 22 to the connection state corresponding to the cooling operation or the cooling dominant operation described above. The control unit 80 thus ends the start-up control, and thereafter executes the cooling operation or the cooling dominant operation described above.

(7) Features of Embodiment

In the refrigeration cycle system 1 of the present embodiment, carbon dioxide is used as the refrigerant in the secondary-side refrigerant circuit 10. Therefore, the global warming potential (GWP) can be kept low. In addition, even if a refrigerant leak occurs on the utilization side, the refrigerant does not contain chlorofluorocarbon, and thus the chlorofluorocarbon does not flow out on the utilization side. Further, in the refrigeration cycle system 1 of the present embodiment, because the dual refrigeration cycle is adopted, sufficient capacity can be provided in the secondary-side refrigerant circuit 10.

In the refrigeration cycle system 1 according to the present embodiment described above, carbon dioxide is used as the refrigerant in the secondary-side refrigerant circuit 10, but the refrigerant pressure of this carbon dioxide refrigerant rapidly increases easily due to the influence of ambient temperature. In particular, during the stop of the operation and in the case when the ambient temperature such as the outside air temperature becomes a high temperature environment of 30° C. to 40° C. to 50° C., there is a risk that the refrigerant pressure rapidly increases in a region of the high-pressure refrigerant in the secondary-side refrigerant circuit 10. Therefore, in the refrigeration cycle system 1 of the present embodiment, by controlling the connection on-off valve 46 to be opened during the stop of the cooling operation or the cooling dominant operation, the region of the high-pressure refrigerant and the region of the low-pressure refrigerant in the secondary-side refrigerant circuit 10 are connected to reduce the refrigerant pressure of the high-pressure refrigerant.

However, when the connection on-off valve 46 is controlled to be opened during the stop of the operation in this manner and the high-pressure refrigerant is guided to the suction flow path 23, the refrigerant pressure in the suction flow path 23 tends to increase. In this case, when the secondary-side compressor 21 is started, the refrigerant in the suction flow path 23 having a relatively high pressure is further compressed, causing a risk of the refrigerant pressure on the discharge side of the secondary-side compressor 21 rapidly increasing.

On the other hand, in the present embodiment, at the start of the cooling operation or at the start of the cooling dominant operation, the start-up control is performed in which the primary-side compressor 71 is started before the secondary-side compressor 21 is started, and the bypass on-off valve 49 is controlled to be opened. As a result, the primary-side flow path **35*b* in the cascade heat exchanger 35 functions as an evaporator for the primary-side refrigerant, which allows the temperature of the secondary-side refrigerant in the secondary-side flow path 35*a* to be lowered. As the temperature of the secondary-side refrigerant in the secondary-side flow path 35*a* decreases, the refrigerant in the suction flow path 23 can be guided to the secondary-side flow path 35*a* via the bypass flow path 47 including the bypass capillary tube 48 and the bypass on-off valve 49 controlled to be opened, and the third heat source pipe 25. As a result, the refrigerant pressure on the secondary side in the suction flow path 23** can be suppressed low.

Therefore, even when the secondary-side compressor 21 is started, because the suction refrigerant suppressed to a relatively low pressure is compressed, the refrigerant pressure on the secondary side on the discharge side can also be suppressed low. In addition, the decrease in temperature of the secondary-side refrigerant in the secondary-side flow path **35*a* of the cascade heat exchanger 35 reduces the pressure of the secondary-side refrigerant in the secondary-side flow path 35*a*, the third heat source pipe 25, and the fourth heat source pipe 26, which enables the high pressure of the secondary-side refrigerant circuit 10 after the secondary-side compressor 21** is started to be suppressed low.

Note that the heat source circuit 12 of the present embodiment does not include, between the cascade heat exchanger 35 and the third shut-off valve 31, a refrigerant container such as a receiver that stores the secondary-side refrigerant, and has a structure in which the pressure of the high-pressure refrigerant on the secondary side easily increases. However, as described above, in the present embodiment, because the start-up control is performed, an abnormal rise of the high-pressure refrigerant on the secondary side can be avoided.

(8) Other Embodiments (8-1) Other Embodiment A

In the above embodiment, the heat source circuit 12 including the bypass flow path 47 connecting the suction flow path 23 to the third heat source pipe 25 has been described as an example.

Figure 8:
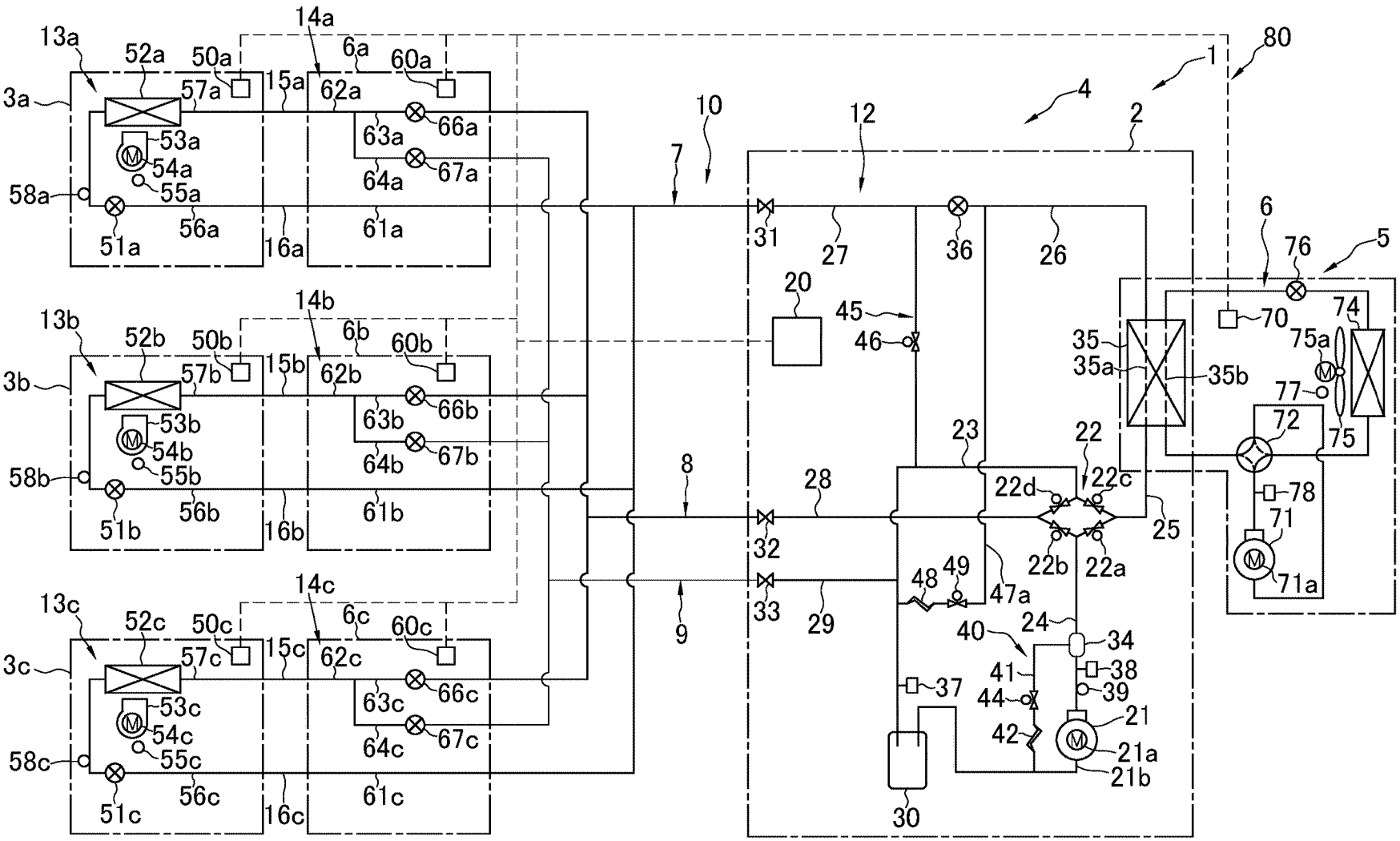
FIG. 8 is a schematic configuration diagram of a refrigeration cycle system according to another embodiment A.

In contrast, for example, as shown in FIG. 8, in the heat source circuit 12, a bypass flow path **47*a* connecting the suction flow path 23 and the fourth heat source pipe 26 may be used instead of the bypass flow path 47** of the above embodiment. This configuration can also exhibit similar advantageous effects to those of the above embodiment.

(8-2) Other Embodiment B

In the above embodiment, the heat source circuit 12 including the bypass flow path 47 connecting the suction flow path 23 to the third heat source pipe 25 has been described as an example.

Figure 9:
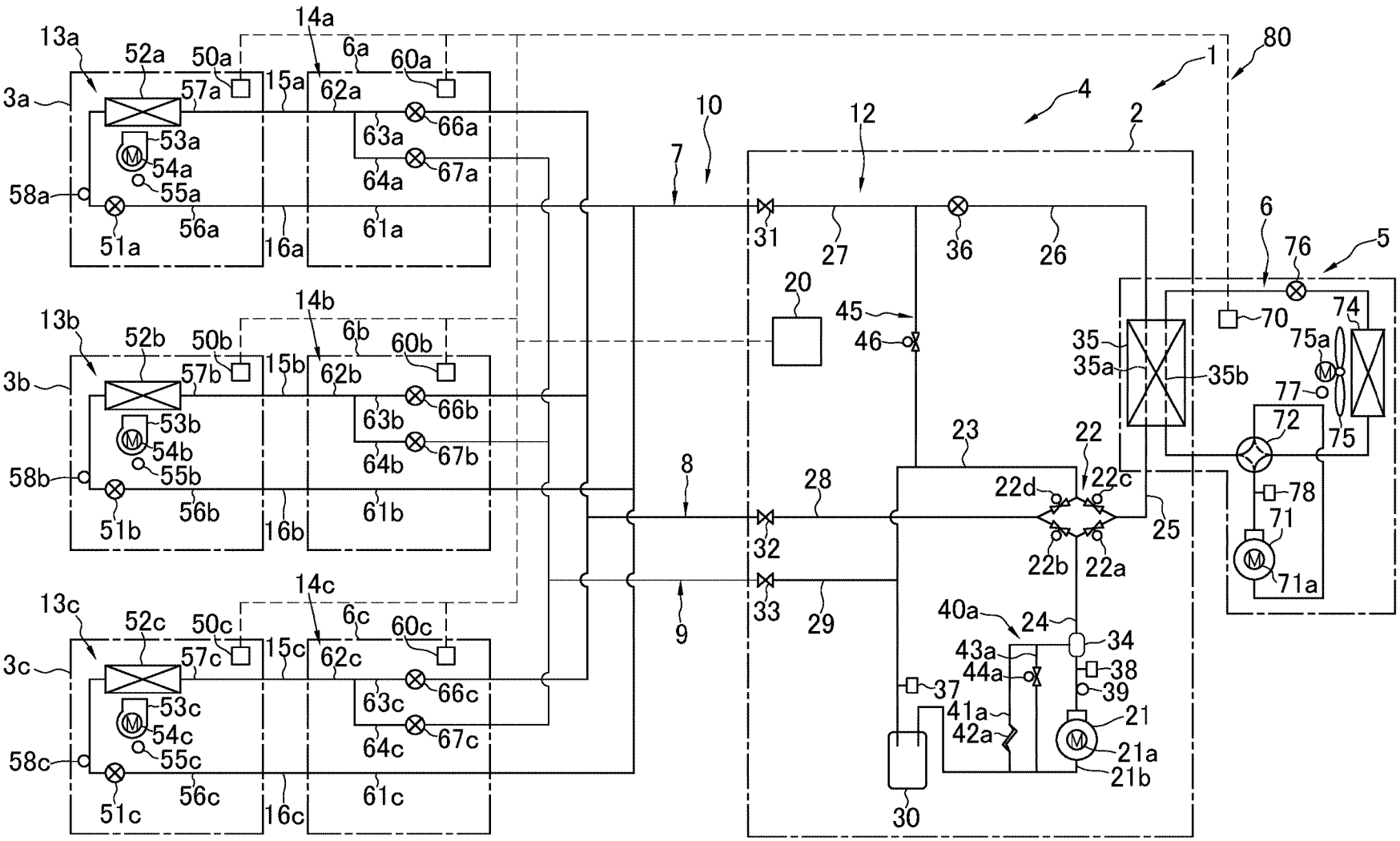
FIG. 9 is a schematic configuration diagram of a refrigeration cycle system according to another embodiment B.

In contrast, for example, as shown in FIG. 9, in the heat source circuit 12, an oil return circuit **40*a* may be used instead of the bypass flow path 47 and the oil return circuit 40** of the above embodiment.

The oil return circuit **40*a* of the present embodiment includes a first oil return flow path 41*a* and a second oil return flow path 43***a* that connect the oil separator 34 and the suction flow path 23 in parallel to each other. The first oil return flow path 41*a* is provided with an oil return capillary tube 42*a*. The second oil return flow path 43*a* is provided with an oil return on-off valve 44*a*. Similarly to the oil return on-off valve 44 of the above embodiment, the oil return on-off valve 44*a* repeats keeping the open state for a predetermined time and keeping the close state for a predetermined time, thereby controlling the amount of refrigerating machine oil returned through the oil return circuit 40*a*.

According to the above configuration, by the start-up control, the secondary-side refrigerant in the suction flow path 23 can be guided to the secondary-side flow path 35*a* in the cascade heat exchanger 35 via the first oil return flow path 41*a* including the oil return capillary tube 42*a*, the oil separator 34, the discharge flow path 24, the secondary-side switching mechanism 22 (the first switching valve 22*a* therein), and the third heat source pipe 25. This configuration can also exhibit similar advantageous effects to those of the above embodiment.

(8-3) Other Embodiment C

In the above embodiment, the description has been made by exemplifying that, in order to suppress the increase in the pressure of the high-pressure refrigerant in the secondary-side refrigerant circuit 10 during the stop of the operation, the connection on-off valve 46 is controlled to be opened during the stop of the operation and this can cause the pressure of the refrigerant in the suction flow path 23 to be increased.

However, the refrigeration cycle system is not limited to the one in which the connection on-off valve 46 is controlled to be opened during the stop of the system, or the refrigeration cycle system is not limited to the one in which the heat source circuit 12 includes the connection flow path 45 and the connection on-off valve 46.

For example, when the ambient temperature of the suction flow path 23 of the secondary-side refrigerant circuit 10 is relatively high during the stop of the operation, the pressure of the secondary-side refrigerant in the suction flow path 23 tends to increase, and thus a problem similar to that in the above embodiment possibly occurs. In particular, because the accumulator 30 is provided in the middle of the suction flow path 23, the refrigerant in the accumulator 30 is affected by the ambient temperature, which causes the above problem to occur easily. Even in these cases, by performing the process of reducing the refrigerant pressure in the suction flow path 23 before starting the secondary-side compressor 21, an abnormal increase in the pressure of the carbon dioxide refrigerant can be avoided.

(8-4) Other Embodiment D

In the above embodiment, the primary-side refrigerant circuit 5*a* through which the refrigerant such as R32 as an example of the heat medium circulates has been described.

In contrast, the heat medium circulating in the primary-side refrigerant circuit 5*a* is not limited, and for example, brine, water, or the like may be used. The primary-side refrigerant circuit 5*a* is not limited to the one in which the compression refrigeration cycle as described above is performed, and may be the one in which brine or water as a low-temperature source is supplied to the cascade heat exchanger 35.

(8-5) Other Embodiment E

In the above embodiment, the description has been made by exemplifying the case where the secondary-side refrigerant circuit 10 includes the secondary-side switching mechanism 22 that causes the cascade heat exchanger 35 to switch between the state of functioning as a radiator for the secondary-side refrigerant and the state of functioning as a heat sink of the secondary-side refrigerant.

In contrast, the secondary-side refrigerant circuit 10 may not include the secondary-side switching mechanism 22 as described above, and may be the one that can operate only to cause the cascade heat exchanger 35 to function as a radiator for the secondary-side refrigerant. In this case, the bypass flow path 47 of the above embodiment may be connected to any location from the utilization-side heat exchangers 52*a*, 52*b*, and 52*c* to the suction side of the secondary-side compressor 21.

(8-6) Other Embodiment F

In the above embodiment, the description has been made by exemplifying the secondary-side unit 4 including the secondary-side expansion valve 36 provided in the heat source unit 2, the utilization-side expansion valves 51*a*, 51*b*, and 51*c* provided in the utilization units 3*a*, 3*b*, and 3*c*, and the first control valves 66*a*, 66*b*, and 66*c* and the second control valves 67*a*, 67*b*, and 67*c* provided in the branch units 6*a*, 6*b*, and 6*c*.

Figure 10:
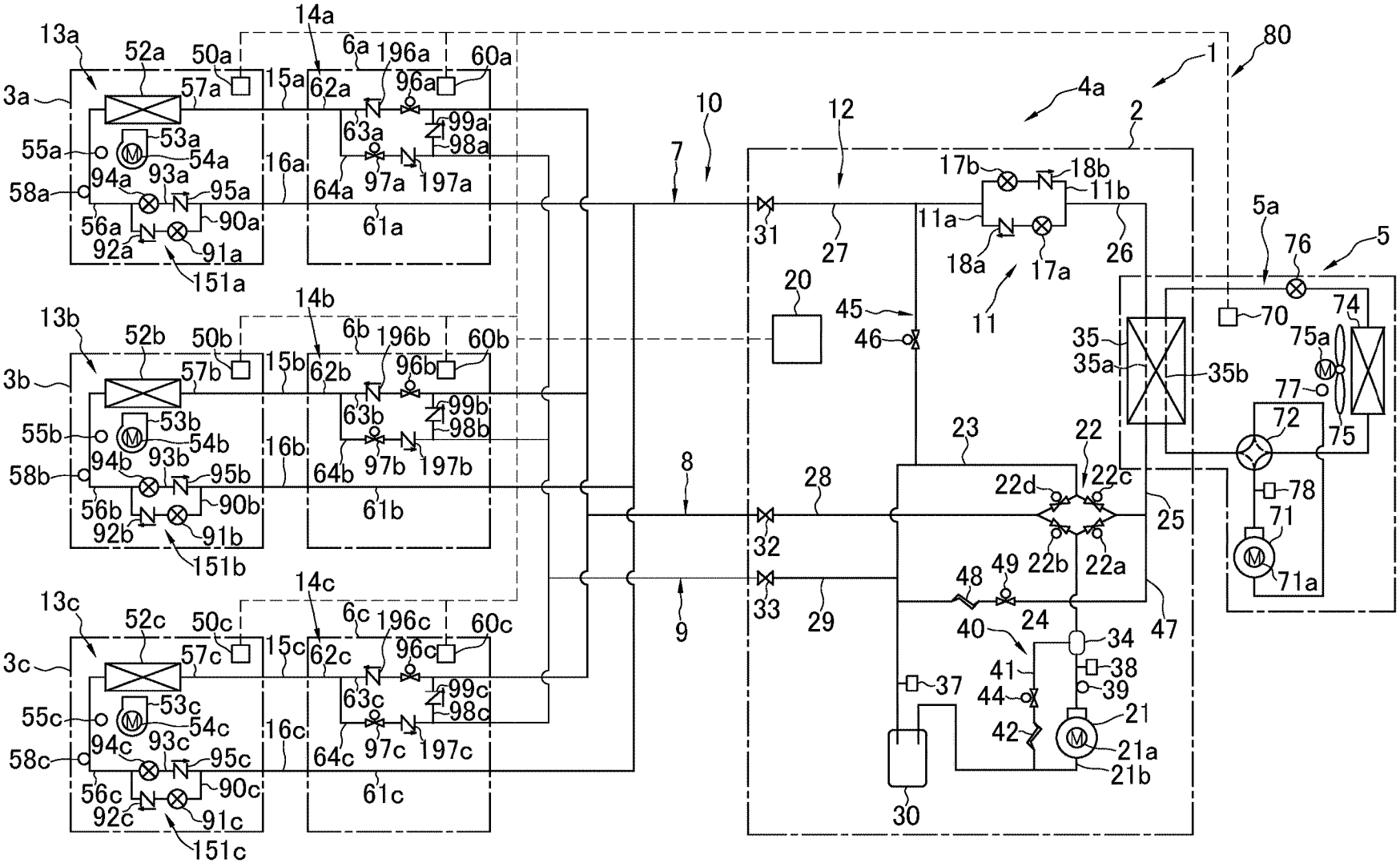
FIG. 10 is a schematic configuration diagram of a refrigeration cycle system according to another embodiment F.

In contrast, the secondary-side unit 4 of the above embodiment may be configured as, for example, a secondary-side unit 4*a* shown in FIG. 10.

The secondary-side unit 4*a* is provided with a heat source-side expansion mechanism 11 (corresponding to a first expansion unit) in the heat source unit 2 instead of the secondary-side expansion valve 36 of the above embodiment. The heat source-side expansion mechanism 11 is provided between the fourth heat source pipe 26 and the fifth heat source pipe 27. The heat source-side expansion mechanism 11 includes a first heat source-side branch flow path 11*a* and a second heat source-side branch flow path 11*b* that are flow paths aligned in parallel to each other. In the first heat source-side branch flow path 11*a*, a first heat source-side expansion valve 17*a* and a first heat source-side check valve 18*a* are provided side by side. In the second heat source-side branch flow path 11*b*, a second heat source-side expansion valve 17*b* and a second heat source-side check valve 18*b* are provided side by side. Each of the first heat source-side expansion valve 17*a* and the second heat source-side expansion valve 17*b* is an electrically powered expansion valve whose opening degree can be controlled. The first heat source-side check valve 18*a* is a check valve that allows only a flow of the refrigerant flowing from the fourth heat source pipe 26 toward the fifth heat source pipe 27 to pass through. The second heat source-side check valve 18*b* is a check valve that allows only a flow of the refrigerant flowing from the fifth heat source pipe 27 toward the fourth heat source pipe 26 to pass through. In the above configuration, the opening degree of the first heat source-side expansion valve 17*a* is controlled when the operation is performed to cause the refrigerant to flow from the fourth heat source pipe 26 toward the fifth heat source pipe 27, and the opening degree of the second heat source-side expansion valve 17*b* is controlled when the refrigerant is caused to flow from the fifth heat source pipe 27 toward the fourth heat source pipe 26. Specifically, the opening degree of the first heat source-side expansion valve 17*a* is controlled during the cooling operation and the cooling dominant operation, and the opening degree of the second heat source-side expansion valve 17*b* is controlled during the heating operation and the heating dominant operation. In the heat source-side expansion mechanism 11 described above, the first heat source-side check valve 18*a* is connected to the first heat source-side expansion valve 17*a*, and the second heat source-side check valve 18*b* is connected to the second heat source-side expansion valve 17*b*. Therefore, the direction of the flow of the refrigerant passing through the first heat source-side expansion valve 17*a* can be limited to one direction, and the direction of the flow of the refrigerant passing through the second heat source-side expansion valve 17*b* can also be limited to one direction. Therefore, even in the case where an expansion valve whose valve opening degree can be controlled to a desired opening degree is difficult to be secured, in a condition where the refrigerant pressure is high or in a condition where the pressure difference between the high-pressure refrigerant and the low-pressure refrigerant is large, the same functional effects as those obtained by the control of the secondary-side expansion valve 36 of the above embodiment can be more reliably obtained.

Here, in the condition where the refrigerant pressure is high or in the condition where the pressure difference between the high-pressure refrigerant and the low-pressure refrigerant is large, the factors that ensure the valve to be controlled to the desired opening degree include the following. Specifically, in the case of using the carbon dioxide refrigerant as the refrigerant for the secondary-side refrigerant circuit 10, the refrigerant is used in a state in which the pressure of the high-pressure refrigerant in the refrigeration cycle is higher than the case of using the conventional refrigerant, such as R32 or R410A. Here, as the expansion valve, the expansion valves that moves a needle with respect to a valve seat to open and close the valve and to control the valve opening degree are used in many cases. At the time of closing the valve or narrowing the valve opening degree, the expansion valve including the needle as described above receives the pressure of the refrigerant at the tip of the needle when the needle is used in a condition where the refrigerant flows in a direction opposite to the direction in which the needle is moved. In this case, because the movement of the needle becomes more suppressed as the refrigerant pressure acting on the tip of the needle increases, there is a risk that the valve opening degree becomes difficult to be controlled to the desired degree. In particular, in the case of using the expansion valve in a direction in which the high-pressure refrigerant acts on the tip side of the needle, and when the difference in the refrigerant pressure between both sides of the expansion valve is large, the valve opening degree cannot be properly closed even if the valve is attempted to be controlled to be fully closed. Therefore, there is a risk that the refrigerant passes between the needle and the valve seat to cause a leak of the refrigerant. In addition, in the case of controlling the expansion valve to have a desired low opening degree, the expansion valve cannot be controlled to have an intended valve opening degree, and as a result, there is a risk that the valve opens more than the desired low opening degree. As described above, in the condition where the refrigerant pressure is high or in the condition where the pressure difference between the high-pressure refrigerant and the low-pressure refrigerant is large, there is a risk that the expansion valve is difficult to be controlled to be in an intended state. On the other hand, in the case of adopting the above-described heat source-side expansion mechanism 11, the above problem can be solved.

The secondary-side unit 4*a* is provided with, instead of the utilization-side expansion valves 51*a*, 51*b*, and 51*c*, utilization-side expansion mechanisms 151*a*, 151*b*, and 151*c* in the utilization units 3*a*, 3*b*, and 3*c* of the above embodiment. Hereinafter, the first utilization-side expansion mechanism 151*a* is described. For the configurations of the second utilization-side expansion mechanism 151*b* and the third utilization-side expansion mechanism 151*c*, instead of a suffix "a" indicating each part of the first utilization-side expansion mechanism 151*a*, a suffix "b" or "c" is added, respectively, and the description of each part is omitted. The first utilization-side expansion mechanism 151*a* is provided in the middle of the second utilization pipe 56*a*. The first utilization-side expansion mechanism 151*a* includes a first utilization-side branch flow path 90*a* and a second utilization-side branch flow path 93*a* that have flow paths aligned in parallel to each other. In the first utilization-side branch flow path 90*a*, a first utilization-side expansion valve 91*a* and a first utilization-side check valve 92*a* are provided side by side. In the second utilization-side branch flow path 93*a*, a second utilization-side expansion valve 94*a* and a second utilization-side check valve 95*a* are provided side by side. Each of the first utilization-side expansion valve 91*a* and the second utilization-side expansion valve 94*a* is an electrically powered expansion valve whose opening degree can be controlled. The first utilization-side check valve 92*a* is a check valve that allows only a flow of the refrigerant flowing from the second connecting pipe 16*a* side toward the utilization-side heat exchanger 52*a* side to pass through. The second utilization-side check valve 95*a* is a check valve that allows only a flow of the refrigerant flowing from the utilization-side heat exchanger 52*a* side toward the second connecting pipe 16*a* side to pass through. In the above configuration, the opening degree of the first utilization-side expansion valve 91*a* is controlled when the operation is performed to cause the refrigerant to flow from the second connecting pipe 16*a* side toward the utilization-side heat exchanger 52*a* side, and the opening degree of the second utilization-side expansion valve 94*a* is controlled when the refrigerant is caused to flow from the utilization-side heat exchanger 52*a* side toward the second connecting pipe 16*a* side. Specifically, the opening degree of the first utilization-side expansion valve 91*a* is controlled during the cooling operation, during the cooling dominant operation when the utilization-side heat exchanger 52*a* functions as an evaporator for the refrigerant, and during the heating dominant operation when the utilization-side heat exchanger 52*a* functions as an evaporator for the refrigerant. The opening degree of the second utilization-side expansion valve 94*a* is controlled during the heating operation, during the cooling dominant operation when the utilization-side heat exchanger 52*a* functions as a radiator for the refrigerant, and during the heating dominant operation when the utilization-side heat exchanger 52*a* functions as a radiator for the refrigerant. In the first utilization-side expansion mechanism 151*a* described above, the first utilization-side check valve 92*a* is connected to the first utilization-side expansion valve 91*a*, and the second utilization-side check valve 95*a* is connected to the second utilization-side expansion valve 94*a*. Therefore, the direction of the flow of the refrigerant passing through the first utilization-side expansion valve 91*a* can be limited to one direction, and the direction of the flow of the refrigerant passing through the second utilization-side expansion valve 94*a* can also be limited to one direction. Therefore, even in the case where an expansion valve whose opening degree can be controlled to a desired opening degree is difficult to be secured, in the condition where the refrigerant pressure is high or in the condition where the pressure difference between the high-pressure refrigerant and the low-pressure refrigerant is large, the same functional effects as those obtained by the control of the utilization-side expansion valve 51*a* of the above embodiment can be more reliably obtained. Note that the same applies to the second utilization-side expansion mechanism 151*b* and the third utilization-side expansion mechanism 151*c*.

In the branch units 6*a*, 6*b*, and 6*c* of the above embodiment, the secondary-side unit 4*a* is provided with, instead of the first control valves 66*a*, 66*b*, and 66*c*, first control valves 96*a*, 96*b*, and 96*c* and first check valves 196*a*, 196*b*, and 196*c*, and provided with, instead of the second control valves 67*a*, 67*b*, and 67*c*, second control valves 97*a*, 97*b*, and 97*c* and second check valves 197*a*, 197*b*, and 197*c*. The secondary-side unit 4*a* further includes, in the branch units 6*a*, 6*b*, and 6*c*, connection flow paths 98*a*, 98*b*, and 98*c* that connect the first branch pipes 63*a*, 63*b*, and 63*c* to the second branch pipes 64*a*, 64*b*, and 64*c*. The connection flow paths 98*a*, 98*b*, and 98*c* are provided with check valves 99*a*, 99*b*, and 99*c*. Hereinafter, the first control valve 96*a*, the second control valve 97*a*, the connection flow path 98*a*, and the check valve 99*a* provided in the first branch unit 6*a* are described. For the corresponding configurations of the second branch unit 6*b* and the third branch unit 6*c*, instead of a suffix "a" indicating each part, a suffix "b" or "c" is added and the description of each part is omitted. In the first branch pipe 63*a*, the first control valve 96*a* and the first check valve 196*a* are provided side by side. In the second branch pipe 64*a*, the second control valve 97*a* and the second check valve 197*a* are provided side by side. Each the first control valve 96*a* and the second control valve 97*a* is an electromagnetic valve that can be switched between the open state and the close state. The first check valve 196*a* is a check valve that allows only a flow of the refrigerant flowing from the first connection pipe 8 toward the junction pipe 62*a* to pass through. The second check valve 197*a* is a check valve that allows only a flow of refrigerant flowing from the junction pipe 62*a* toward the second connection pipe 9 to pass through. The connection flow path 98*a* connects a portion of the first branch pipe 63*a* closer to the first connection pipe 8 side than to the first control valve 96*a* and the first check valve 196*a* to a portion of the second branch pipe 64*a* closer to the second connection pipe 9 side than to the second control valve 97*a* and the second check valve 197*a*. The check valve 99*a* allows only a flow of the refrigerant flowing from the second branch pipe 64*a* toward the first branch pipe 63*a*. In the above configuration, during the cooling operation, the second control valve 97*a* is controlled to be opened and the first control valve 96*a* is controlled to be closed. As a result, a part of the refrigerant, having evaporated in the utilization-side heat exchanger 52*a* and having passed through the second control valve 97*a* of the second branch pipe 64*a*, flows through the second connection pipe 9, and the remaining part of the refrigerant passes through the check valve 99*a* of the connection flow path 98*a* and flows to the first connection pipe 8. During the heating operation, the first control valve 96*a* is controlled to be opened and the second control valve 97*a* is controlled to be closed. As a result, during a first heating operation, the refrigerant having flowed through the first connection pipe 8 joins with the refrigerant having flowed through the second connection pipe 9 and having passed through the check valve 99*a* of the connection flow path 98*a*, and the joined refrigerant flows to pass through the first control valve 96*a*. Note that, during a second heating operation, the refrigerant having flowed through the first connection pipe 8 flows to pass through the first control valve 96*a*. When the utilization-side heat exchanger 52*a* functions as an evaporator for the refrigerant during the cooling dominant operation and the heating dominant operation, the first control valve 96*a* is controlled to be closed and the second control valve 97*a* is controlled to be opened. As a result, the refrigerant having evaporated in the utilization-side heat exchanger 52*a* passes through the second control valve 97*a* of the second branch pipe 64*a* and flows to the second connection pipe 9. When the utilization-side heat exchanger 52*a* functions as a radiator for the refrigerant during the cooling dominant operation and the heating dominant operation, the first control valve 96*a* is controlled to be opened and the second control valve 97*a* is controlled to be closed. As a result, the refrigerant having flowed through the first connection pipe 8 is allowed to pass through the first control valve 96*a* of the first branch pipe 63*a* and is sent to the utilization-side heat exchanger 52*a*. Note that each of the first control valve 96*a* and the second control valve 97*a* is an electromagnetic valve including a needle that moves with respect to a valve seat. Therefore, the same problem as the above problem that the valve becomes difficult to be controlled to be in an intended state can possibly occur. On the other hand, as described above, according to the configuration in which the first control valve 96*a* and the first check valve 196*a*, and the second control valve 97*a* and the second check valve 197*a*, are provided in parallel to each other, the direction of the flow of the refrigerant passing through the first control valve 96*a* can be limited to one direction, and the direction of the flow of the refrigerant passing through the second control valve 97*a* can also be limited to one direction. Therefore, even in the case where an electromagnetic valve that can be controlled to be in a desired close state is difficult to be secured, in the condition where the refrigerant pressure is high or in the condition where the pressure difference between the high-pressure refrigerant and the low-pressure refrigerant is large, the same functional effects as those obtained by the control of the first control valve 66*a* and the second control valve 67*a* of the above embodiment can be more reliably obtained. Note that the same applies to a configuration in which the first control valve 96*b* and the first check valve 196*b*, and the second control valve 97*b* and the second check valve 197*b* are provided in parallel to each other, and a configuration in which the first control valve 96*c* and the first check valve 196*c*, and the second control valve 97*c* and the second check valve 197*c*, are provided in parallel to each other.

Note that, in the first branch unit 6*a*, each of the first control valve 96*a* and the second control valve 97*a* may be an electrically powered expansion valve whose opening degree can be controlled instead of an electromagnetic valve. Specifically, a configuration may be adopted in which the first control valve 96*a* being an electrically powered expansion valve and the first check valve 196*a*, and the second control valve 97*a* being an electrically powered expansion valve and the second check valve 197*a*, are provided in parallel to each other. The same applies to the second branch unit 6*b* and the third branch unit 6*c*.

As described above, the secondary-side unit 4*a* can also operate in the same manner as the secondary-side unit 4 of the above embodiment.

Note that providing the heat source-side expansion mechanism 11 instead of the secondary-side expansion valve 36 of the above embodiment, providing the utilization-side expansion mechanisms 151*a*, 151*b*, and 151*c* instead of the utilization-side expansion valves 51*a*, 51*b*, and 51*c*, and providing the connection flow paths 98*a*, 98*b*, and 98*c* and the check valves 99*a*, 99*b*, and 99*c* while providing the first control valves 96*a*, 96*b*, and 96*c* and the first check valves 196*a*, 196*b*, and 196*c* instead of the first control valves 66*a*, 66*b*, and 66*c* and while providing the second control valves 97*a*, 97*b*, and 97*c* and the second check valves 197*a*, 197*b*, and 197*c* instead of the second control valves 67*a*, 67*b*, and 67*c*, are matters independent of each other. Therefore, an embodiment in which these are appropriately combined may be adopted.

Note that, even in the secondary-side unit 4*a* including both of: the utilization units 3*a*, 3*b*, and 3*c* provided with the utilization-side expansion mechanisms 151*a*, 151*b*, and 151*c*; and the branch units 6*a*, 6*b*, and 6*c* in which the first control valves 96*a*, 96*b*, and 96*c* and the first check valves 196*a*, 196*b*, and 196*c*, and the second control valves 97*a*, 97*b*, and 97*c* and the second check valves 197*a*, 197*b*, and 197*c*, are provided in parallel, the utilization unit in the operation stop state may be included during the various operations, similarly to the above embodiment. In this case, for example, when the utilization units 3*a*, 3*b*, and 3*c* including the utilization-side heat exchangers 52*a*, 52*b*, and 52*c* that function as evaporators for the refrigerant, are brought into the operation stop state, the utilization-side expansion mechanisms 151*a*, 151*b*, and 151*c* included in the utilization units 3*a*, 3*b*, and 3*c* brought into the operation stop state are controlled to be closed. More specifically, the first utilization-side expansion valves 91*a*, 91*b*, and 91*c* included in the utilization units 3*a*, 3*b*, and 3*c* brought into the operation stop state are controlled to be closed. In addition, when the utilization units 3*a*, 3*b*, and 3*c* including the utilization-side heat exchangers 52*a*, 52*b*, and 52*c* that function as radiators for the refrigerant, are brought into the operation stop state, the control is performed by, for example, either a control pattern 1 or a control pattern 2. In the control pattern 1, the first utilization-side expansion valves 91*a*, 91*b*, and 91*c* and the second utilization-side expansion valves 94*a*, 94*b*, and 94*c* of the utilization-side expansion mechanisms 151*a*, 151*b*, and 151*c* included in the utilization units 3*a*, 3*b*, and 3*c* brought into the operation stop state are controlled to be closed, and the first control valves 96*a*, 96*b*, and 96*c* included in the branch units 6*a*, 6*b*, and 6*c* connected corresponding to the utilization units 3*a*, 3*b*, and 3*c* brought into the operation stop state are controlled to be closed. In the control pattern 2, the second utilization-side expansion valves 94*a*, 94*b*, and 94*c* of the utilization-side expansion mechanisms 151*a*, 151*b*, and 151*c* included in the utilization units 3*a*, 3*b*, and 3*c* brought into the operation stop state are controlled to be in a predetermined low opening degree, and the first control valves 96*a*, 96*b*, and 96*c* included in the branch units 6*a*, 6*b*, and 6*c* connected corresponding to the utilization units 3*a*, 3*b*, and 3*c* brought into the operation stop state are controlled to be opened.

(8-7) Other Embodiment G

In the above embodiment, the cascade heat exchanger 35 shared by the heat source unit 2 and the primary-side unit 5 has been described.

Figure 11:
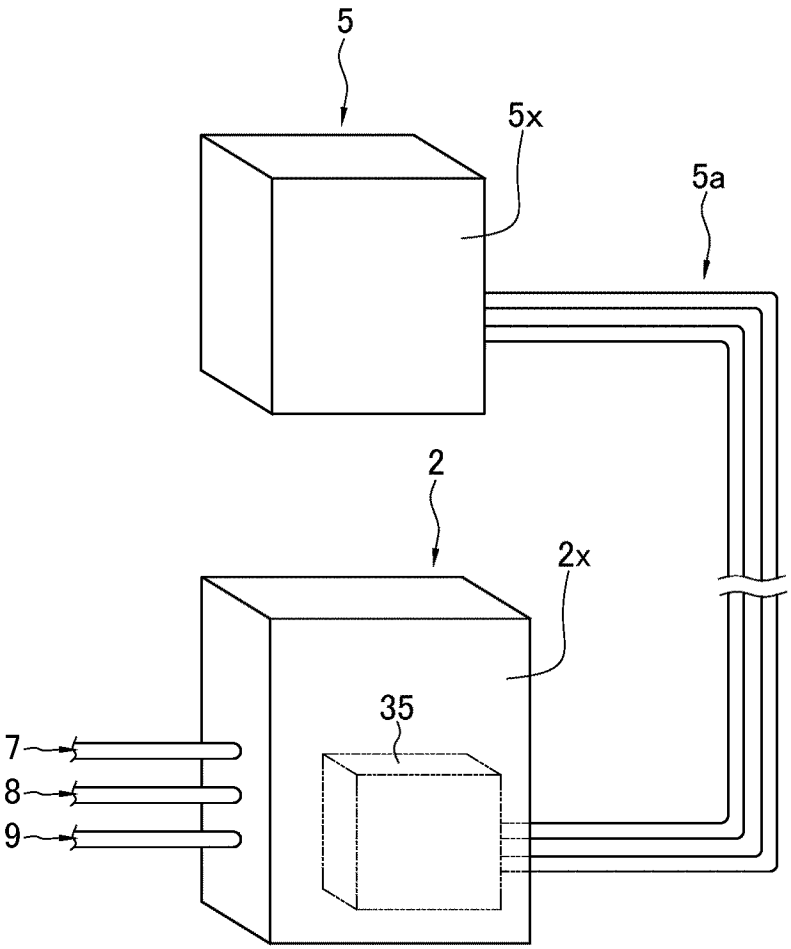
FIG. 11 is a schematic configuration diagram showing a connection mode between a heat source unit and a primary-side unit according to another embodiment G.

Here, for example, as shown in FIG. 11, the cascade heat exchanger 35 may be accommodated in a heat source casing 2*x* included in the heat source unit 2, and may be connected to the refrigerant pipe of the primary-side refrigerant circuit 5*a* extending to the outside of a primary-side casing 5*x* of the primary-side unit 5.

In addition to the cascade heat exchanger 35, devices included in the heat source unit 2 is accommodated in the heat source casing 2*x*. The primary-side casing 5*x* accommodates, as devices constituting a part of the primary-side refrigerant circuit 5*a*, the primary-side compressor 71, the primary-side switching mechanism 72, the primary-side heat exchanger 74, the primary-side expansion valve 76, the primary-side fan 75, the outside air temperature sensor 77, the primary-side discharge pressure sensor 78, the primary-side control unit 70, and the like.

The heat source casing 2*x* accommodating the above-described devices and the primary-side casing 5*x* accommodating the above-described devices may be both disposed outdoors such as on the rooftop of a building, and may be connected to each other via the refrigerant pipe of the primary-side refrigerant circuit 5*a*.

Alternatively, the heat source casing 2*x* accommodating the above-described devices may be disposed in an indoor space such as a machine chamber being a separate space from an air conditioning target space provided indoors, and the primary-side casing 5*x* accommodating the above-described devices may be disposed outdoors such as on the rooftop of a building, and the two casings may be connected to each other via the refrigerant pipe of the primary-side refrigerant circuit 5*a*.

(8-8) Others

Note that the first flow path may be a flow path extending between the discharge side of the first compressor and one end of the cascade heat exchanger. The second flow path may be a flow path extending between the other end of the cascade heat exchanger and the first expansion unit. The third flow path may be a flow path extending between one end of the first heat exchanger and the suction side of the first compressor. The cascade heat exchanger may cause heat exchange between the carbon dioxide refrigerant circulating in the first cycle and the heat medium circulating in the second cycle.

Note that the first cycle may include a switching mechanism that switches the flow of the refrigerant. In the case where the first cycle includes the switching mechanism, the third flow path may be a flow path extending from the switching mechanism to the suction side of the first compressor. Further, in the case where the first cycle includes the switching mechanism, the first flow path may be a flow path extending from the switching mechanism to the one end of the cascade heat exchanger.

In addition, the bypass flow path may connect at least one of the first flow path and the second flow path to the third flow path at all times, or may connect the above flow paths to enable switching between the connected state and the non-connected state using an on-off valve or the like.

Further, the heat medium circulating in the second cycle is not limited as long as the heat medium is the one that is different from the carbon dioxide refrigerant, and may be, for example, R32, brine, water, or the like.

The on-off valve may be the one that can be switched between two states, the open state and the close state, or may be the one in which a valve opening degree is controllable.

In addition, the on-off valve may be in the open state from the time before the heat medium starts flowing into the cascade heat exchanger to the time when the heat medium starts flowing into the cascade heat exchanger in the second cycle.

Although the embodiments of the present disclosure have been described above, it will be understood that various changes in form and details can be made without departing from the spirit and scope of the present disclosure described in claims.

REFERENCE SIGNS LIST

1: refrigeration cycle system
2: heat source unit
3*a*: first utilization unit
3*b*: second utilization unit
3*c*: third utilization unit
4: secondary-side unit
5: primary-side unit
5*a*: primary-side refrigerant circuit (second cycle)
6*a*, 6*b*, 6*c*: branch unit
7: liquid-refrigerant connection pipe
8: high and low pressure gas-refrigerant connection pipe
9: low pressure gas-refrigerant connection pipe
10: secondary-side refrigerant circuit (first cycle)
11: heat source-side expansion mechanism (first expansion unit)
12: heat source circuit
13*a-c*: utilization circuit
20: heat source-side control unit
21: secondary-side compressor (first compressor)
21*a*: compressor motor
22: secondary-side switching mechanism (switching mechanism)
23: suction flow path (third flow path)
24: discharge flow path
25: third heat source pipe (first flow path)
26: fourth heat source pipe (second flow path)
27: fifth heat source pipe
28: first heat source pipe
29: second heat source pipe
30: accumulator
31: third shut-off valve
32: first shut-off valve
33: second shut-off valve
34: oil separator
35: cascade heat exchanger
35*a*: secondary-side flow path
35*b*: primary-side flow path
36: secondary-side expansion valve (first expansion unit)
37: secondary-side suction pressure sensor (sensor that detects refrigerant pressure or
refrigerant temperature in third flow path)
38: secondary-side discharge pressure sensor
39: secondary-side discharge temperature sensor
40: oil return circuit
40*a*: oil return circuit
41: oil return flow path (bypass flow path)
41*a*: first oil return flow path (bypass flow path)
42: oil return capillary tube
42*a*: oil return capillary tube
43*a*: second oil return flow path
44: oil return on-off valve
44*a*: oil return on-off valve
45: connection flow path
46: connection on-off valve
47: bypass flow path
47*a*: bypass flow path
48: bypass capillary tube (decompression mechanism)
49: bypass on-off valve (on-off valve)
50*a-c*: utilization-side control unit
51*a-c*: utilization-side expansion valve
52*a-c*: utilization-side heat exchanger (first heat exchanger)
56*a*, 56*b*, 56*c*: second utilization pipe
57*a*, 57*b*, 57*c*: first utilization pipe
58*a*, 58*b*, 58*c*: liquid-side temperature sensor
60*a*, 60*b*, 60*c*: branch unit control unit
61*a*, 61*b*, 61*c*: third branch pipe
62*a*, 62*b*, 62*c*: junction pipe
63*a*, 63*b*, 63*c*: first branch pipe
64*a*, 64*b*, 64*c*: second branch pipe
66*a*, 66*b*, 66*c*: first control valve
67*a*, 67*b*, 67*c*: second control valve
70: primary-side control unit
71: primary-side compressor (second compressor)
72: primary-side switching mechanism
74: primary-side heat exchanger
76: primary-side expansion valve
77: outside air temperature sensor
78: primary-side discharge pressure sensor
80: control unit

CITATION LIST

Patent Literature

Patent Literature 1: JP 2004-190917 A

The invention claimed is:

1. A refrigeration cycle system comprising:
a first cycle; and
a second cycle,
wherein
the first cycle is connected with a first compressor, a cascade heat exchanger, a first expansion unit, and a first heat exchanger, has a carbon dioxide refrigerant circulating through the first cycle, and includes a first flow path that connects the first compressor to the cascade heat exchanger, a second flow path that connects the cascade heat exchanger to the first expansion unit, a third flow path that connects the first heat exchanger to the first compressor, and a bypass flow path that connects at least one of the first flow path and the second flow path to the third flow path,
the second cycle includes the cascade heat exchanger, and has a heat medium different from the carbon dioxide refrigerant circulating through the second cycle, and
in a case of using the cascade heat exchanger as a radiator of the first cycle and a heat sink of the second cycle, the first compressor of the first cycle is started after a flow of the heat medium generates in the cascade heat exchanger in the second cycle,
wherein the bypass flow path includes an on-off valve that can be opened and closed, and
in the case of using the cascade heat exchanger as the radiator of the first cycle and the heat sink of the second cycle, the on-off valve is in an open state from after the heat medium starts to flow in the cascade heat exchanger in the second cycle until the first compressor is started, and the on-off valve is switched to a close state when or after the first compressor is started.

2. The refrigeration cycle system according to claim 1, wherein
the second cycle includes a second compressor, and
in the case of using the cascade heat exchanger as the radiator of the first cycle and the heat sink of the second cycle, the first compressor is started after the second compressor is started.

3. The refrigeration cycle system according to claim 1, further comprising a sensor that detects a refrigerant pressure or a refrigerant temperature in the third flow path,
wherein in the case of using the cascade heat exchanger as the radiator of the first cycle and the heat sink of the second cycle, the first compressor is started when a detection value of the sensor is a predetermined value or less.

4. The refrigeration cycle system according to claim 1, further comprising a sensor that detects a refrigerant pressure or a refrigerant temperature in the third flow path, wherein in the case of using the cascade heat exchanger as the radiator of the first cycle and the heat sink of the second cycle, the first compressor is started when either of a detection value of the sensor is a predetermined value or less, and a predetermined time has elapsed after the heat medium starts to flow in the cascade heat exchanger in the second cycle, is satisfied.

5. The refrigeration cycle system according to claim 1, wherein the bypass flow path includes a decompression mechanism that decompresses the refrigerant.

6. The refrigeration cycle system according to claim 1, wherein the first cycle further includes a switching mechanism, the switching mechanism switches between a state of sending the refrigerant discharged from the first compressor to the cascade heat exchanger and a state of sending the refrigerant discharged from the first compressor to the first heat exchanger, the third flow path includes a suction flow path that connects the switching mechanism to the first compressor, the bypass flow path connects at least one of the first flow path and the second flow path to the suction flow path, and in a case where the switching mechanism is in the state of sending the refrigerant discharged from the first compressor to the cascade heat exchanger, the cascade heat exchanger is started to operate as the radiator of the first cycle and as the heat sink of the second cycle.

7. The refrigeration cycle system according to claim 2, further comprising a sensor that detects a refrigerant pressure or a refrigerant temperature in the third flow path, wherein in the case of using the cascade heat exchanger as the radiator of the first cycle and the heat sink of the second cycle, the first compressor is started when a detection value of the sensor is a predetermined value or less.

8. The refrigeration cycle system according to claim 2, further comprising a sensor that detects a refrigerant pressure or a refrigerant temperature in the third flow path, wherein in the case of using the cascade heat exchanger as the radiator of the first cycle and the heat sink of the second cycle, the first compressor is started when either of a detection value of the sensor is a predetermined value or less, and a predetermined time has elapsed after the heat medium starts to flow in the cascade heat exchanger in the second cycle, is satisfied.

9. The refrigeration cycle system according to claim 2, wherein the bypass flow path includes a decompression mechanism that decompresses the refrigerant.

10. The refrigeration cycle system according to claim 3, wherein the bypass flow path includes a decompression mechanism that decompresses the refrigerant.

11. The refrigeration cycle system according to claim 4, wherein the bypass flow path includes a decompression mechanism that decompresses the refrigerant.

12. The refrigeration cycle system according to claim 2, wherein the bypass flow path includes an on-off valve that can be opened and closed, and in the case of using the cascade heat exchanger as the radiator of the first cycle and the heat sink of the second cycle, the on-off valve is in an open state from after the heat medium starts to flow in the cascade heat exchanger in the second cycle until the first compressor is started, and the on-off valve is switched to a close state when or after the first compressor is started.

13. The refrigeration cycle system according to claim 3, wherein the bypass flow path includes an on-off valve that can be opened and closed, and in the case of using the cascade heat exchanger as the radiator of the first cycle and the heat sink of the second cycle, the on-off valve is in an open state from after the heat medium starts to flow in the cascade heat exchanger in the second cycle until the first compressor is started, and the on-off valve is switched to a close state when or after the first compressor is started.

14. The refrigeration cycle system according to claim 4, wherein the bypass flow path includes an on-off valve that can be opened and closed, and in the case of using the cascade heat exchanger as the radiator of the first cycle and the heat sink of the second cycle, the on-off valve is in an open state from after the heat medium starts to flow in the cascade heat exchanger in the second cycle until the first compressor is started, and the on-off valve is switched to a close state when or after the first compressor is started.

15. The refrigeration cycle system according to claim 5, wherein the bypass flow path includes an on-off valve that can be opened and closed, and in the case of using the cascade heat exchanger as the radiator of the first cycle and the heat sink of the second cycle, the on-off valve is in an open state from after the heat medium starts to flow in the cascade heat exchanger in the second cycle until the first compressor is started, and the on-off valve is switched to a close state when or after the first compressor is started.

16. The refrigeration cycle system according to claim 2, wherein the first cycle further includes a switching mechanism, the switching mechanism switches between a state of sending the refrigerant discharged from the first compressor to the cascade heat exchanger and a state of sending the refrigerant discharged from the first compressor to the first heat exchanger, the third flow path includes a suction flow path that connects the switching mechanism to the first compressor, the bypass flow path connects at least one of the first flow path and the second flow path to the suction flow path, and in a case where the switching mechanism is in the state of sending the refrigerant discharged from the first compressor to the cascade heat exchanger, the cascade heat exchanger is started to operate as the radiator of the first cycle and as the heat sink of the second cycle.

17. The refrigeration cycle system according to claim 3, wherein the first cycle further includes a switching mechanism, the switching mechanism switches between a state of sending the refrigerant discharged from the first compressor to the cascade heat exchanger and a state of sending the refrigerant discharged from the first compressor to the first heat exchanger, the third flow path includes a suction flow path that connects the switching mechanism to the first compressor, the bypass flow path connects at least one of the first flow path and the second flow path to the suction flow path, and in a case where the switching mechanism is in the state of sending the refrigerant discharged from the first compressor to the cascade heat exchanger, the cascade heat exchanger is started to operate as the radiator of the first cycle and as the heat sink of the second cycle.

18. The refrigeration cycle system according to claim 4, wherein the first cycle further includes a switching mechanism, the switching mechanism switches between a state of sending the refrigerant discharged from the first compressor to the cascade heat exchanger and a state of sending the refrigerant discharged from the first compressor to the first heat exchanger, the third flow path includes a suction flow path that connects the switching mechanism to the first compressor, the bypass flow path connects at least one of the first flow path and the second flow path to the suction flow path, and in a case where the switching mechanism is in the state of sending the refrigerant discharged from the first compressor to the cascade heat exchanger, the cascade heat exchanger is started to operate as the radiator of the first cycle and as the heat sink of the second cycle.

19. The refrigeration cycle system according to claim 5, wherein the first cycle further includes a switching mechanism, the switching mechanism switches between a state of sending the refrigerant discharged from the first compressor to the cascade heat exchanger and a state of sending the refrigerant discharged from the first compressor to the first heat exchanger, the third flow path includes a suction flow path that connects the switching mechanism to the first compressor, the bypass flow path connects at least one of the first flow path and the second flow path to the suction flow path, and in a case where the switching mechanism is in the state of sending the refrigerant discharged from the first compressor to the cascade heat exchanger, the cascade heat exchanger is started to operate as the radiator of the first cycle and as the heat sink of the second cycle.

20. A refrigeration cycle system comprising:

a first cycle; and a second cycle, wherein the first cycle is connected with a first compressor, a cascade heat exchanger, a first expansion unit, and a first heat exchanger, has a carbon dioxide refrigerant circulating through the first cycle, and includes a first flow path that connects the first compressor to the cascade heat exchanger and having an oil separator, a second flow path that connects the cascade heat exchanger to the first expansion unit, a third flow path that connects the first heat exchanger to the first compressor, a bypass flow path that connects at least one of the first flow path and the second flow path to the third flow path, and an oil return circuit that connects the oil separator and the third flow path, the second cycle includes the cascade heat exchanger, and has a heat medium different from the carbon dioxide refrigerant circulating through the second cycle, and in a case of using the cascade heat exchanger as a radiator of the first cycle and a heat sink of the second cycle, the first compressor of the first cycle is started after the carbon dioxide refrigerant in the third flow path is guided to the cascade heat exchanger via the bypass flow path during a period from when a flow of the heat medium generates in the cascade heat exchanger in the second cycle until the first compressor is started.

* * * * *